US009643078B1

(12) United States Patent
Sines et al.

(10) Patent No.: US 9,643,078 B1
(45) Date of Patent: May 9, 2017

(54) CARD SHUFFLER

(71) Applicant: Stealth CDS, LLC, Seattle, WA (US)

(72) Inventors: Travis L. Sines, Seattle, WA (US); Leon Schmidt, Spokane, WA (US); Bruce Weyrauch, Spokane Valley, WA (US); Michael Denney, Rathdrum, ID (US); James Kesler, Chino, CA (US); Philip Malthaner, Spokane, WA (US)

(73) Assignee: Stealth CDS, LLC, Seattle, WA (US)

( * ) Notice: Subject to any disclaimer, the term of this patent is extended or adjusted under 35 U.S.C. 154(b) by 0 days.

(21) Appl. No.: 15/378,829

(22) Filed: Dec. 14, 2016

(51) Int. Cl.
*A63F 1/12* (2006.01)
*A63F 11/00* (2006.01)

(52) U.S. Cl.
CPC ..... *A63F 1/12* (2013.01); *A63F 11/0002* (2013.01)

(58) Field of Classification Search
CPC ..... A63F 1/12; A63F 11/0002
USPC ..... 273/149 R, 149 P; 463/22
See application file for complete search history.

(56) References Cited

U.S. PATENT DOCUMENTS 5,275,411 A 1/1994 Breeding
5,575,475 A * 11/1996 Steinbach ..... A63F 1/12 273/149 R
5,584,483 A 12/1996 Sines et al.
5,676,372 A 10/1997 Sines et al.
5,695,189 A 12/1997 Breeding et al.
6,019,368 A 2/2000 Sines et al.
6,068,258 A 5/2000 Breeding et al.
6,149,154 A 11/2000 Grauzer et al.
6,254,096 B1 7/2001 Grauzer et al.
6,267,248 B1 7/2001 Johnson et al.
6,299,167 B1 10/2001 Sines et al.
6,651,982 B2 11/2003 Grauzer et al.
6,676,127 B2 1/2004 Johnson et al.
7,523,935 B2 4/2009 Grauzer et al.
7,677,565 B2 3/2010 Grauzer et al.
7,988,152 B2 8/2011 Sines
8,342,526 B1 1/2013 Sampson et al.
8,469,360 B2 6/2013 Sines
8,485,527 B2 7/2013 Sampson et al.
9,138,635 B1 9/2015 Sines
2004/0036214 A1 2/2004 Baker et al.
(Continued)

*Primary Examiner* — Benjamin Layno
(74) *Attorney, Agent, or Firm* — Mark P. Walters; Lowe Graham Jones PLLC

(57) ABSTRACT

The disclosed invention includes all embodiments for a mechanical shuffler comprising a generally planar base and a platform that is sized to receive a deck of unshuffled cards, the stack of unshuffled cards moves relative to a slot where the slot is sized to permit passage of a single card. With movement of a platform relative to a slot, a discrete burst of air is delivered to a stack of unshuffled cards, thereby pushing a single card through the slot and into an area where shuffled cards are to be delivered. It is contemplated that embodiments of the invention will include means for the delivery of a discrete amount of air in response to a computer signal, it is further contemplated that embodiments of the invention may include rollers that are engaged to spin and grip a card that is pushed through a slot by air. It is contemplated that embodiments of the invention may include a set of perforated guiding members that include a plurality of perforations that are sized to permit and diffuse a predetermined amount of air by volume and pressure.

19 Claims, 22 Drawing Sheets

(56) References Cited

U.S. PATENT DOCUMENTS

| | | | | |
|---|---|---|---|---|
| 2004/0169332 | A1 | 9/2004 | Grauzer et al. | |
| 2008/0284096 | A1 | 11/2008 | Toyama et al. | |
| 2009/0314188 | A1 | 12/2009 | Toyama et al. | |
| 2010/0144445 | A1* | 6/2010 | Gioia | A63F 1/12 463/42 |
| 2011/0175285 | A1 | 7/2011 | Tzeng | |
| 2011/0233863 | A1* | 9/2011 | Toyama | A63F 1/08 273/149 R |
| 2011/0272881 | A1 | 11/2011 | Sines | |
| 2013/0020761 | A1 | 1/2013 | Sines et al. | |
| 2013/0256989 | A1 | 10/2013 | Baker et al. | |
| 2013/0285324 | A1 | 10/2013 | Sines | |
| 2013/0300059 | A1 | 11/2013 | Sampson et al. | |
| 2014/0027979 | A1 | 1/2014 | Stasson et al. | |
| 2014/0327208 | A1 | 11/2014 | Grauzer et al. | |

* cited by examiner

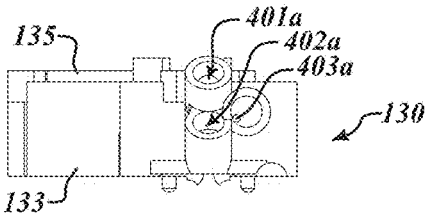
FIG.20
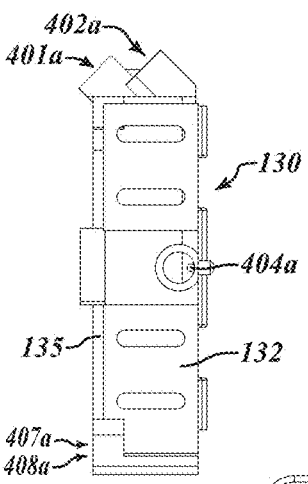
FIG.21
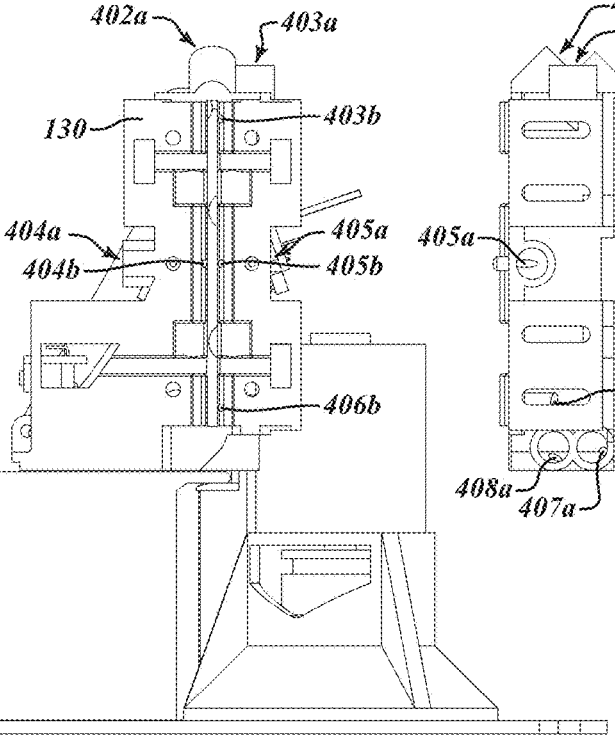
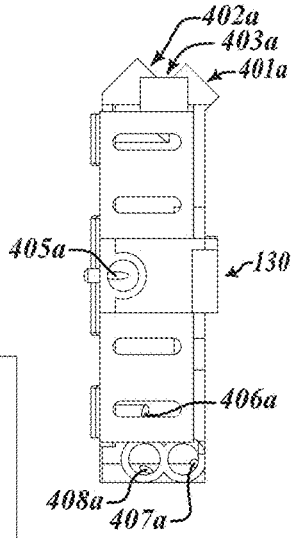
FIG.22
FIG.23
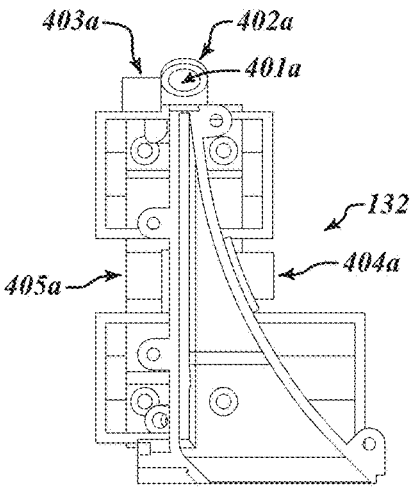
FIG.24

CARD SHUFFLER

FIELD OF THE INVENTION

The invention relates to a card shuffler and more particularly to a mechanical card shuffler for randomly shuffling playing cards.

BACKGROUND OF THE INVENTION

Casinos, card rooms, and other gaming establishments employ many dealers. The dealers shuffle cards, deal the cards, take bets, and otherwise play the game. Substantial amounts of the dealers' time is spent shuffling the decks of cards in preparation for the ensuing hands. During the time the dealer is shuffling, the game table is inactive and bets are not being placed. From the standpoint of the casino, it is desirable to minimize the time spent in preparing the decks of cards for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Another problem area suffered by both manual and automated shuffling techniques is associated with having concentrated groupings of cards. These concentrations or "slugs" can occur with respect to cards having a value of 10 such as in playing blackjack. A skilled card-counting gambler can take advantage of such slugs to turn the odds against the casino and in favor of the card counter. Such slugs can also indicate the failure of prior art shufflers to effectively rearrange the order of cards in a deck or decks being shuffled.

Thus there remains a strong need for improved shuffling machines which can effectively reorder a deck or series of decks. Additionally, there remains a need for an improved automatic shuffler which is relatively easy to build, operate, and maintain.

In one shuffler of the prior art, U.S. Pat. No. 5,584,483, ejectors are mounted adjacent an unshuffled stack holder, which can be stationary or movable. Cards are ejected and discharged from the unshuffled stack at various random positions. The ejectors can be mounted on a movable carriage. Ejectors of this sort can be problematic because they can damage the card edges from impact and generate dust that can foul the internal workings of the apparatus unless it is consistently cleaned and maintained. Furthermore, the ejector apparatus does not fully deliver the card to the shuffled stack, so a variety of problems can happen with the delivery of the card. For example, sometimes the ejector can hit more than one card causing doubles or more to be delivered to the shuffled stack. Moreover, if two cards are stuck together for one reason or another, they often will not become separated upon impact of the ejector, causing doubles to be delivered to the shuffled stack.

In another shuffler of the prior art, U.S. Pat. No. 7,988,152, an unshuffled stack of cards sits on-edge and an exciter is adapted to impart vibrational action to the supported cards in the unshuffled stack. Cards drop in a random fashion by controlling the relative position of the cards over one or more card slots. These arrangements function well enough in terms of shuffling the cards, however, the system only allows for entering cards "on edge," not easily permitting the continuous addition of spent cards that have been played to the unshuffled deck for reshuffling and therefore continuous dispensing of cards. For certain games, such as, for example, Pai Gow, it is advantageous to provide the ability to place spent cards back in the shuffler for shuffling without having to completely empty the shuffler of unshuffled cards.

Another problem with prior art shufflers of the type described above in U.S. Pat. No. 7,988,152 is that the cards drop by the force of gravity and can become snagged or stuck and not fall into place if the cards are damaged or warped. Furthermore, the slot through which unshuffled cards pass is located underneath the unshuffled cards and the unshuffled card sits on an edge and must rotate into a horizontal plane to be delivered to the dealer. This rotation adds extra time before the dealer may deal cards. In a casino environment, time efficiencies are extremely important to keep games moving and increase the number and amounts of bets placed, so the additional time to rotate the cards into a horizontal plane prior to dealing can add up.

An additional problem presented by shufflers of the prior art such as those disclosed in U.S. Pat. No. 7,988,152 is that the slot through which cards pass from the unshuffled stack into the shuffled stack can become jammed with one or more cards. This is because there is no mechanism by which the cards are completely delivered through the slot from the unshuffled deck to the shuffled deck. Absent such a complete delivery mechanism, there exists substantial risk of doubles making it through the slot or of the slot becoming jammed with one or more cards. Furthermore, the leading edge of the card may not always hit the center of the slot, causing impact and damage to the leading edge of the card, which also generates dust and can foul the internal mechanisms of the shuffler.

In the prior art shuffler of the kind described in U.S. Pat. No. 8,342,526 a shuffler is provided that uses one or more rollers and a pushing member which is used to "seat" unshuffled cards into a dealing rack (shuffled card rack). Each card is rolled off the bottom of the stack in a sequential order and is placed in a position in a rack which is randomly positioned to accept such card. These various types of shufflers suffer from a variety of problems related to the use of rollers and multiple moving parts and mechanisms. The rollers in general move the cards through a variety of twists and turns and, in so doing, the cards can become warped and damaged. The shufflers of these various types also involve several different sets of moving parts and mechanisms. The use of multiple moving parts and mechanisms can provide areas for breakdown in the shuffling apparatus and require repeated and constant maintenance or frequent repair. Furthermore, shufflers involving multiple moving mechanisms of this type can take up a lot of space.

Therefore, there exists a need for a mechanical shuffler that is compact and can shuffle cards on the fly in a continuous fashion so as to not substantially interrupt play. There also exists a need for a mechanical shuffler that avoids the use of ejectors, rollers, or like mechanisms which can damage the cards and generate excessive amounts of card dust that might foul the internal mechanisms of the shuffler. There also exists a need for a shuffler that completely and randomly delivers a single card at a time from an unshuffled stack to a shuffled stack and thereby avoids the problem of cards snagging to jamming in the shuffling mechanism. Finally there exists a need for a mechanical shuffler that is programmable for dealing hands specific to certain types of games wherein spent cards may be placed directly back into the machine at any time during the play to be further dealt so as to avoid delays in play.

SUMMARY OF THE INVENTION

The invention includes all embodiments for a mechanical shuffler comprising a generally planar base, a platform sized to receive at least one deck of unshuffled cards, the platform movable in a direction of travel parallel to the generally planar base, a first electrically powered motor mechanically coupled to the platform and configured to move the platform in response to a first signal, a slot positioned adjacent to the platform and sized to receive a single card from a deck of unshuffled cards, wherein the deck of unshuffled cards rests atop the platform and wherein the slot is in communication with an area for the delivery of shuffled cards, a primary air manifold attached to a manifold plate, the manifold having at least one hole configured to deliver a burst of air to an edge of a playing card, the hole configured to deliver the burst of air in a direction towards the slot.

The invention further includes all embodiments for a mechanical shuffler comprising a generally planar base, a platform sized to receive at least one deck of unshuffled cards, the platform movable in a direction of travel parallel to the generally planar base, a first electrically powered motor mechanically coupled to the platform and configured to move the platform in response to a first signal, a slot positioned adjacent to the platform and sized to receive a single card from a deck of unshuffled cards, wherein the deck of unshuffled cards rests atop the platform and wherein the slot is in communication with an area for the delivery of shuffled cards, a chute located in the area for delivery of shuffled cards, the chute including a plurality of perforations, the perforations configured to diffuse a burst of air of a predefined pressure and volume.

The invention further includes all embodiments of a mechanical shuffler comprising a generally planar base, a platform sized to receive at least one deck of unshuffled cards, the platform movable in a direction of travel parallel or normal to the generally planar base member, a first electrically powered motor mechanically coupled to the platform and configured to move the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards, a primary air manifold attached to a manifold plate, the manifold plate having at least one hole configured to deliver a burst of air to at least one edge of a playing card, the hole configured to deliver the burst of air in a direction toward the slot.

BRIEF DESCRIPTION OF THE DRAWINGS

Preferred and alternative examples of the present invention are described in detail below with reference to the following drawings:

FIG. 20 is a top planar view of a secondary manifold made in accordance with principles of the present invention.

FIG. 21 is a side planar view of a secondary manifold made in accordance with principles of the present invention.

FIG. 22 is a side planar view of a secondary manifold made in accordance with principles of the present invention.

FIG. 23 is a side planar view of part of a shuffler mechanism made in accordance with principles of the present invention.

FIG. 24 is a side planar view of part of a secondary manifold made in accordance with principles of the present invention.

DETAILED DESCRIPTION OF THE PREFERRED EMBODIMENT

Figure 1:
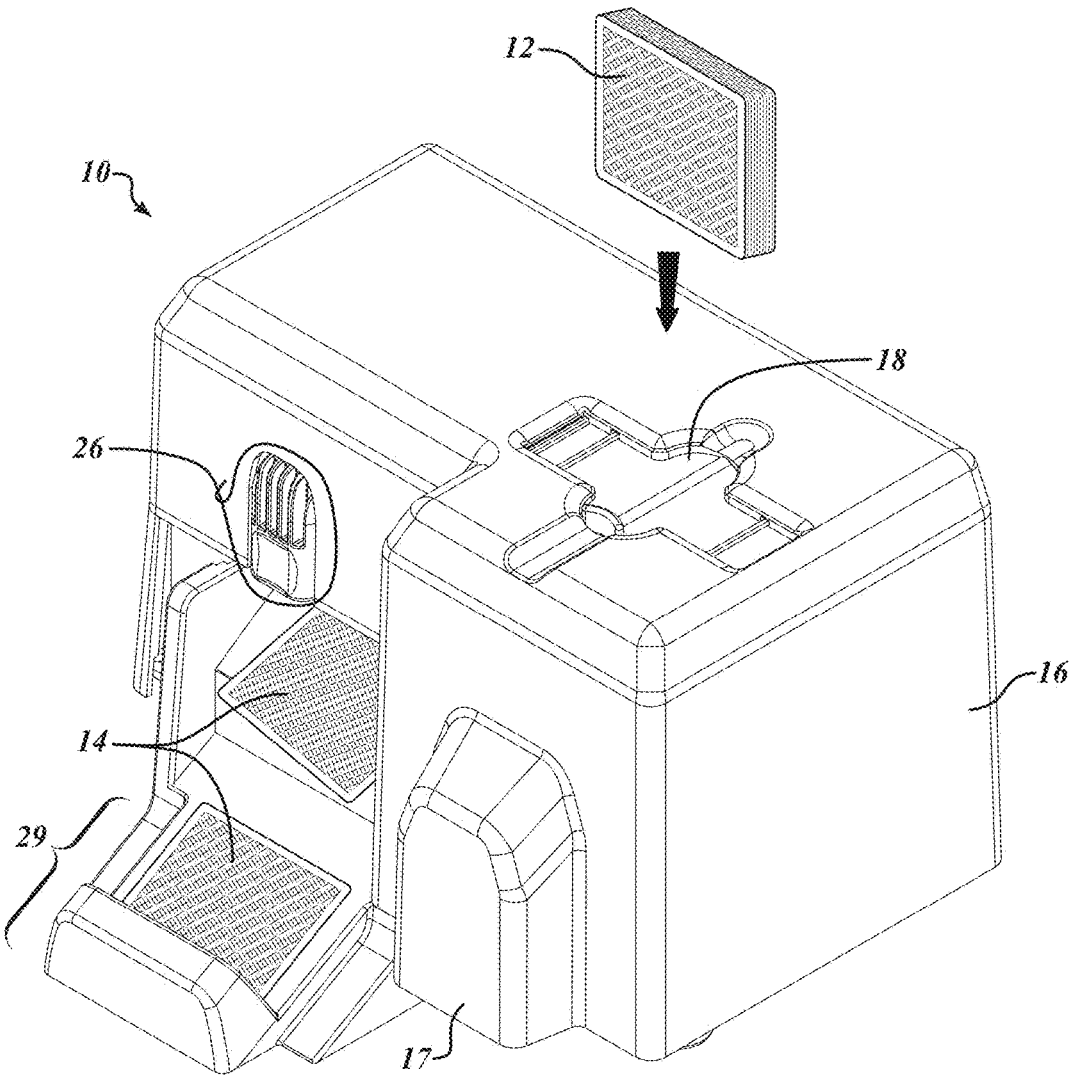
FIG. 1 is a perspective view of a mechanical shuffler made in accordance with principles of the present invention.

Mechanical shuffler 10 is shown in FIG. 1 with the cover 16. Preferably, the cover is made from an opaque or semi-opaque plastic, but the invention also contemplates use of a translucent plastic material. The shuffler 10 includes a receiving space 18 that is cut into the top of cover 16. The receiving space 18 is sized to receive cards to be shuffled 12. These cards to be shuffled 12 can be cards from a newly opened deck of cards or they can be cards from spent (i.e., played) cards dealt. Element 26 shows an area for display of indicator lights and element 17 shows an extended cover piece to accommodate mechanical movement within the shuffler.

Receiving space 18 is also formed into the top of cover 16. Receiving space 18 may include one or more guiding members (not shown), used to straighten the stack of unshuffled cards 12 such that any misaligned cards are put into proper alignment so that the entire stack of unshuffled cards 12 can be placed inside of receiving space 18. As depicted in the illustrated embodiment, receiving space 18 has rounded corners and includes cover recesses 20 and 22. Cover recesses 20 and 22 are sized to allow fingers to access unshuffled cards 12 from wither side. Alternative shapes and configurations are contemplated.

Shuffled cards 14 are dispensed as shown in FIG. 1 through a card catch assembly 29. The card catch assembly 22 is integrally formed into the cover 16 but can alternatively be a separate piece and in any configuration suitable for dispensing cards or hands to be dealt.

Figure 2:
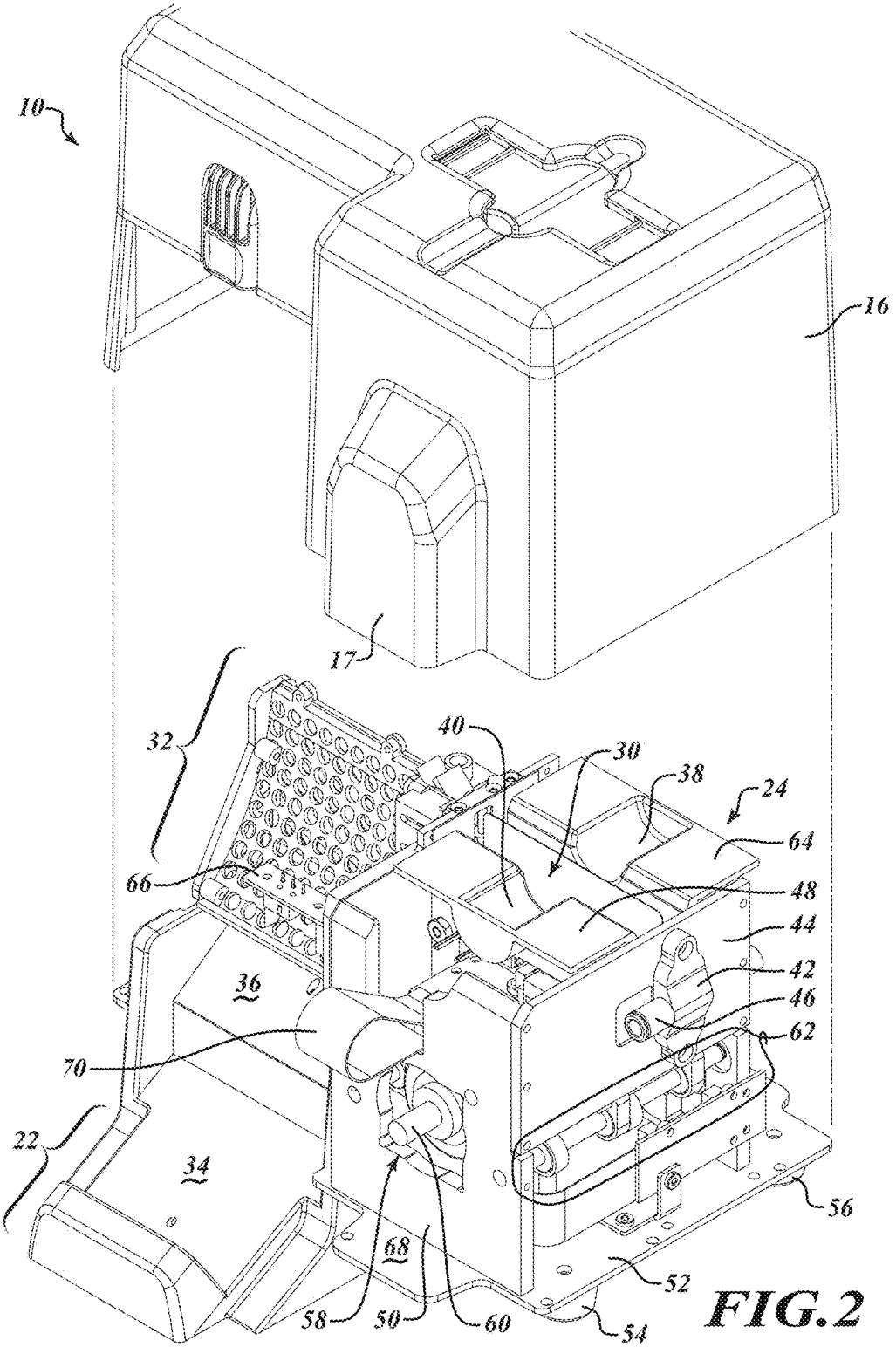
FIG. 2 is a perspective view of a mechanical shuffler made in accordance with principles of the present invention with the cover removed.

With reference now to FIG. 2 cover 16 is removable and when so removed exposes the internal shuffling mechanism 24 of the illustrated embodiment. One of ordinary skill in the art will appreciate that that particular mechanical arrangements for shuffler 10 and in particular, the internal shuffling mechanism 24, can vary widely and that specific embodiment illustrated is not intended to limit the invention claimed to the particular mechanics employed or illustrated. With that said, FIG. 2 shows that shuffler 10 and an internal shuffling mechanism 24. Internal shuffling mechanism 24 is comprised of several features which will be explained with reference to FIG. 2.

Internal shuffling mechanism 24 includes an area where a card to be shuffled 30 is disposed. In operation, shuffling mechanism 24 includes an assembly that permits card to be shuffled 30 to move in a direction parallel to generally planar base member 52. As shown in FIG. 2, card to be shuffled 30 is oriented on its side such that the long side of cards to be shuffled 30 is parallel with generally planar base member 52. Internal shuffling mechanism 24 includes a rear top plate 64 along with a front top plate 48 both front top plate 48 and rear top plate 64 include recessed areas 38 and 40 respectively. Recessed areas 38 and 40 respectively allow a user to access card to be shuffled 30 from either side such that fingers can grasp card to be shuffled 30 from either sides at an area below the plane in which rear top plate 64 and front top plate 48 exist.

With continuing reference to FIG. 2, shuffling mechanism 24 includes perforated guiding members 32. Perforated guiding members 32 include a plurality of circular holes. One of ordinary skill in the art will appreciate that perforated guiding members can be made of any number of holes arranged in any suitable collection of sizes and locations such that a predetermined amount of air is evenly dispersed throughout the structure without damaging or otherwise hindering the delivery of a card from a stack of a shuffled cards to an area where shuffled cards are delivered. In practice shuffling mechanism 24 includes an area where shuffled cards are delivered, that area comprises perforated guiding members 32, upper card landing area 36, and lower card landing area 34. Perforated guiding members 32 are oriented at an angle permitting the card to be gently delivered by the force of gravity to upper card landing area 36, and then on to lower card landing area 34. Lower card landing area 34 is the area where the dealer will grasp shuffled cards. Card catchment area 22, comprises lower card landing area 34 as well as a number of elements configured to hold shuffled cards in a manner permitting easy collection by a dealer throughout the play of the game.

Perforated guiding members 32 are configured preferably to diffuse a predetermined amount of air by pressure, volume, and/or any other measure. In this fashion, air that enters shuffler mechanism 24 passes through perforated guiding members 32 at a particular speed and containing a particular force that is desirable for the safe delivery of cards to be shuffled 12 to the card catchment area 29 which in the depicted embodiment comprises the area for the delivery of shuffled cards. One of ordinary skill will appreciate that cards made of standard paper material can withstand certain forces, shear forces, and otherwise before they will bend or tear. One of ordinary skill in the art will thereby determine (with this criteria in mind) the speed at which air may flow through perforated guiding members 32 and the forces at which such air bursts can impact a card before the card will tear or bend.

With continuing reference to FIG. 2, shuffling mechanism 24 includes a primary manifold 42 a manifold plate 44 and an air inlet 46. Primary air manifold 42 as depicted in this embodiment, is affixed securely to manifold plate 44. One of ordinary skill in the art will appreciate that manifold plate 44 can be formed as and from the same piece as primary manifold 42. For example, a single piece of material can be molded to form the primary air manifold 42 along with the manifold plate 44 and air inlet 46. The invention is by no means limited to a design in which several pieces are used to deliver air to shuffling mechanism 24. As depicted however and as explained in further detail in FIG. 4, air can be delivered to shuffling mechanism 24 using primary air manifold 42 that is affixed to manifold plate 44.

Shuffling mechanism 24 delivers a burst of air through primary air manifold 42 which passes through air manifold plate 44 and comes into contact with at least one edge of card to be shuffled 30. It should be mentioned that the illustrated embodiment shown in FIG. 2 includes a single card. This is by no means limiting. Card to be shuffled 30 is shown for illustrative purposes and it is contemplated that an entire stack or partial stack or multiple stacks of cards to be shuffled can be placed in the area of shuffling mechanism 24 between primary air manifold 42 and the area where shuffled cards are delivered, i.e., the area comprising in general perforated guiding members 32 upper card landing area 36 and lower card landing area 34.

In practice, it is preferred that a burst of air is delivered from one side of the cards to be shuffled 30 at a random location within a stack of cards to be shuffled 30 and that this burst of air is focused on pushing a single card from a stack of cards to be shuffled to an area where shuffled cards can be collected by a dealer, such as card catchment area 29. It is further contemplated that this delivery of a card to be shuffled from a stack of unshuffled cards to an area where shuffled cards exist will be accomplished by a focused burst of air. This focused burst of air is preferably delivered by way of an air manifold 42 as well as an air manifold plate 44, however other ways of delivering a focused burst of air to move a single card into an area where cards to be shuffled are located, are fully contemplated and within the scope of this invention.

Base plate 52 is supported by feet 54 and 56 (and at least two other feet that are not depicted) which creates an area of clearance underneath base plate 52 raising shuffler mechanism 24 off the table. FIG. 2 also shows shuffling mechanism 24 which includes base plate extension 68 which is meant to include an outside edge matching cover protrusions 17 within cover 16. As depicted, shuffling mechanism 24 moves cards to be shuffled 30 horizontally, in a direction parallel to generally planar base member 52. This moving assembly includes at least one horizontal linear stepper motor 60. Stepper motor 60, moves front and back through void 58. The linear motion of the assembly configured to move a stack of cards to be shuffled 30 back and forth along a plane parallel with generally planar base member 52 includes a variety of flexible cabling 70 which is designed to move along with the shuffling assembly. It should be mentioned that the depicted embodiment shows an assembly that is configured to move a stack of cards to be shuffled 30 within a plane that is parallel to the generally planar base member 52. It is however contemplated by the invention to configure the assembly to move the stack of cards to be shuffled in a manner that is normal to the generally planar base member 52. For example, U.S. Pat. No. 9,138,635 (incorporated by reference herein), describes an articulating platform of a kind usable in accordance with principles of the present invention.

Shuffling mechanism 24 includes various parts of an assembly that is configured to move a stack of unshuffled cards back and forth relative to air manifold 42. Air manifold 42 delivers a burst of air in response to an electronic signal. The electronic signal causing air manifold 42 to deliver a burst of their may come from a computer or from some other electronic means. In practice, the signal will trigger the burst of air and cause it to flow through air manifold 42. Air manifold 42 in combination with manifold plate 44 will further direct that burst of air to at least one edge of the card to be shuffled 30. The various mechanisms contemplated by the invention in order to move a stack of cards to be shuffled relative to the burst of air can take on a variety of configurations.

Figure 3:
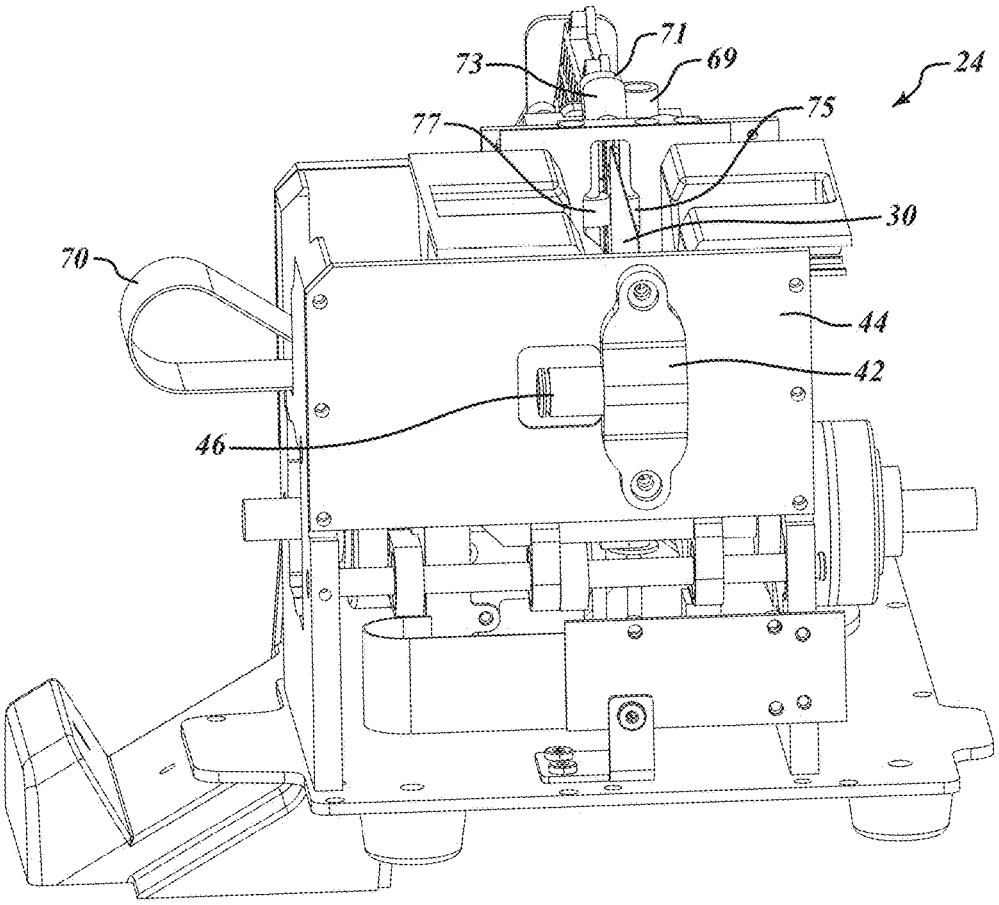
FIG. 3 is a perspective top view of a shuffler mechanism made in accordance with principles of the present invention with the cover removed.
Figure 4:
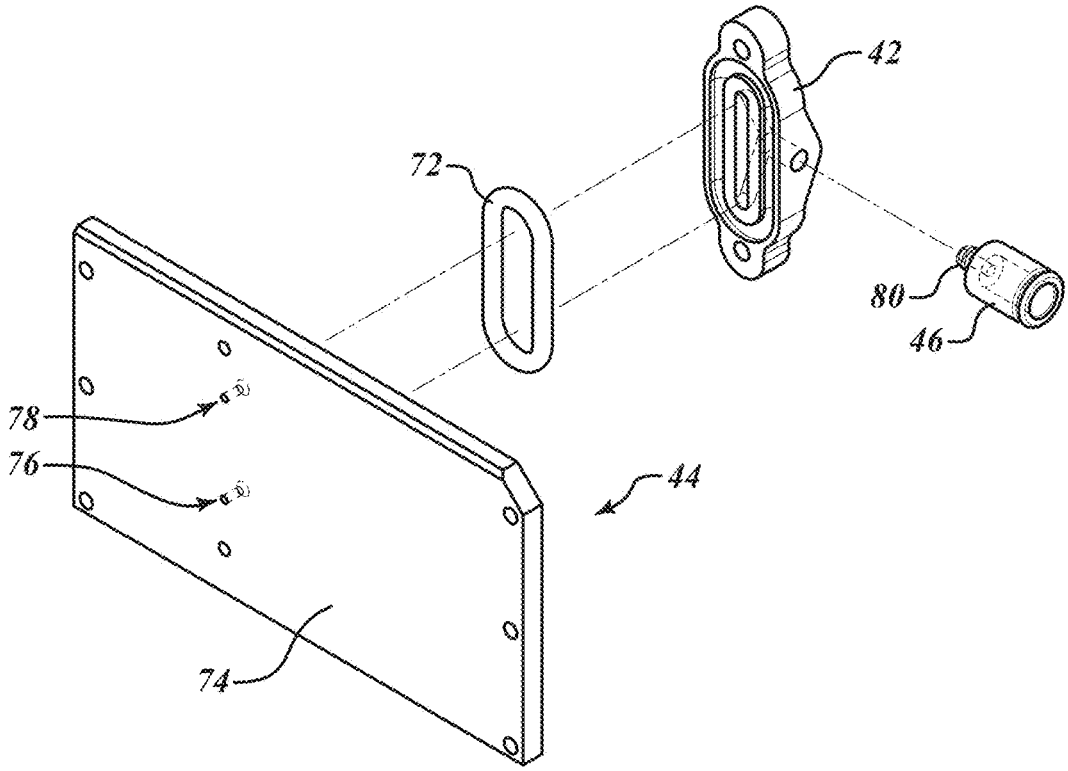
FIG. 4 is a perspective drawing showing a primary manifold, o-ring, and manifold plate made in accordance with principles of the present invention.

FIG. 3 shows shuffling mechanism 24 in a perspective side view including the air inlet 46, the air manifold 42 and the manifold plate 44. FIG. 3 also shows flexible cable 70 which moves along with the movement of the assembly configured to move a stack of cards to be shuffled relative to air manifold 42 it should be noted however that the depicted embodiment includes a manifold 42 which is located substantially in alignment with air hole 78 and air hole 76. As depicted, the air holes 76 and 78 are of a circular configuration, however, the air holes can be of any other configuration and number suitable for optimizing the movement of a card. Moreover, the air holes 76 and 78 may include nozzles or other additional features that focus the airstream. FIG. 4 shows how O-ring 72 seals air manifold 42 to base plate 44. FIG. 4 also shows how air inlet 46 includes threads 80 which securely connect air inlet to manifold 42. Other arrangements of delivering a burst of air to at least one edge of card to be shuffled 30 are contemplated by the invention including, as previously mentioned, a single piece molded construction delivering a burst of air to the edge of a card to be shuffled 30. Moreover, it is contemplated by the present invention that any number of air holes such as those shown in FIG. 4 within base plate 44 can be used so long as the air is delivered in a manner to focus the burst of air on an edge of a single card in a stack of cards to be shuffled 30.

Figure 6:
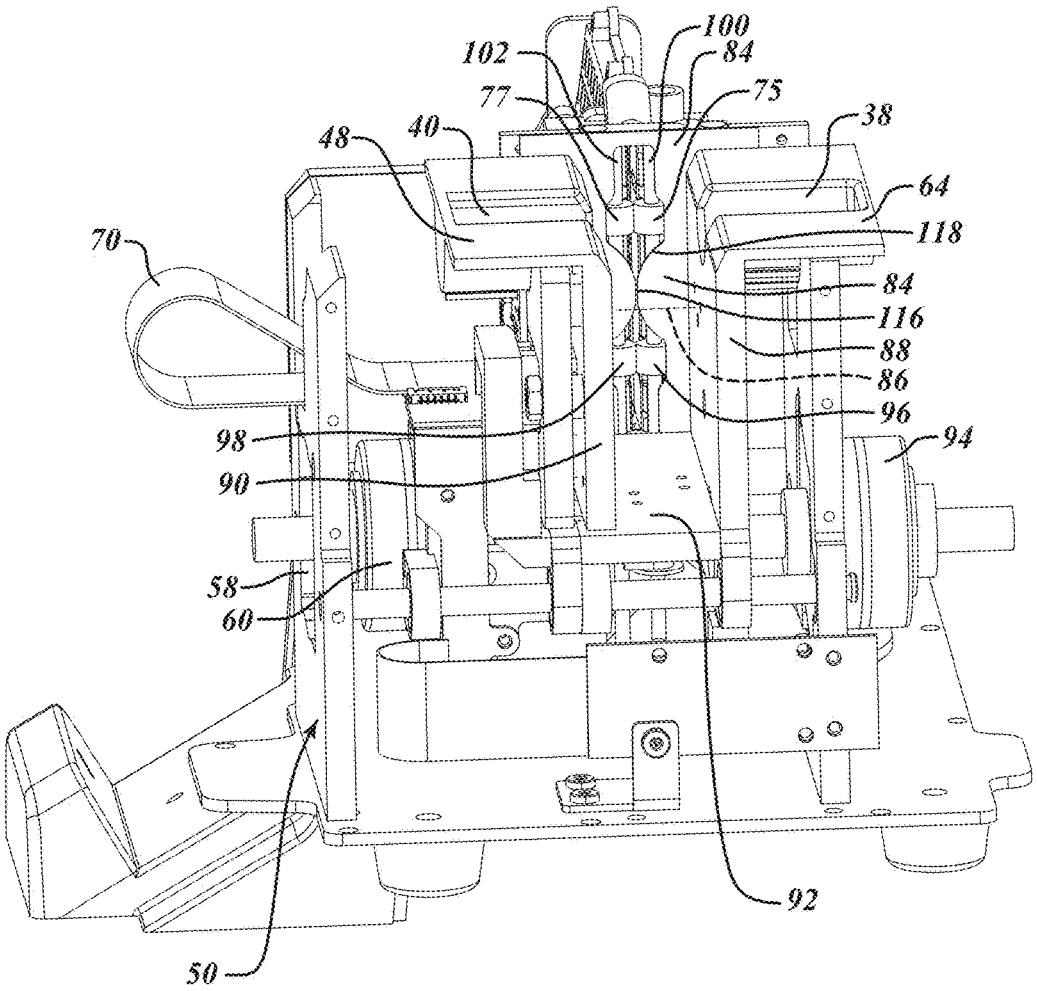
FIG. 6 is a perspective top view of a shuffler mechanism made in accordance with principles of the present invention with the cover removed.

With continuing reference to FIG. 3 one can see how card to be shuffled 30 can be pushed by a burst of air from air manifold 42 through base plate 44 such that the burst of air causes a single card to be shuffled 32 engage rollers 77 and 75 which rollers are set spinning, thereby grasping card to be shuffled 30 and moving it into an area for the delivery of shuffled cards. FIG. 3 also shows how air manifold 42 is in alignment with card to be shuffled 30. With reference now to FIG. 6 and FIG. 3 as well as FIG. 4, air holes 78 and 76 which are drilled through plate 44 exit the rear surface of plate 44 (element 74 in FIG. 4) within the same plane. The plane in which air holes 78 and 76 reside is also the plane in which slot 116 is located as best seen in FIG. 6. In this manner, i.e., by aligning air holes 78 and 76 in the same plane as card to be shuffled 30 and in the same plane as slot 116, card to be shuffled 30 is moved by a burst of air through slot 116 and thereby engaged by spinning rollers 77, 75, 98, and 96.

Figure 5:
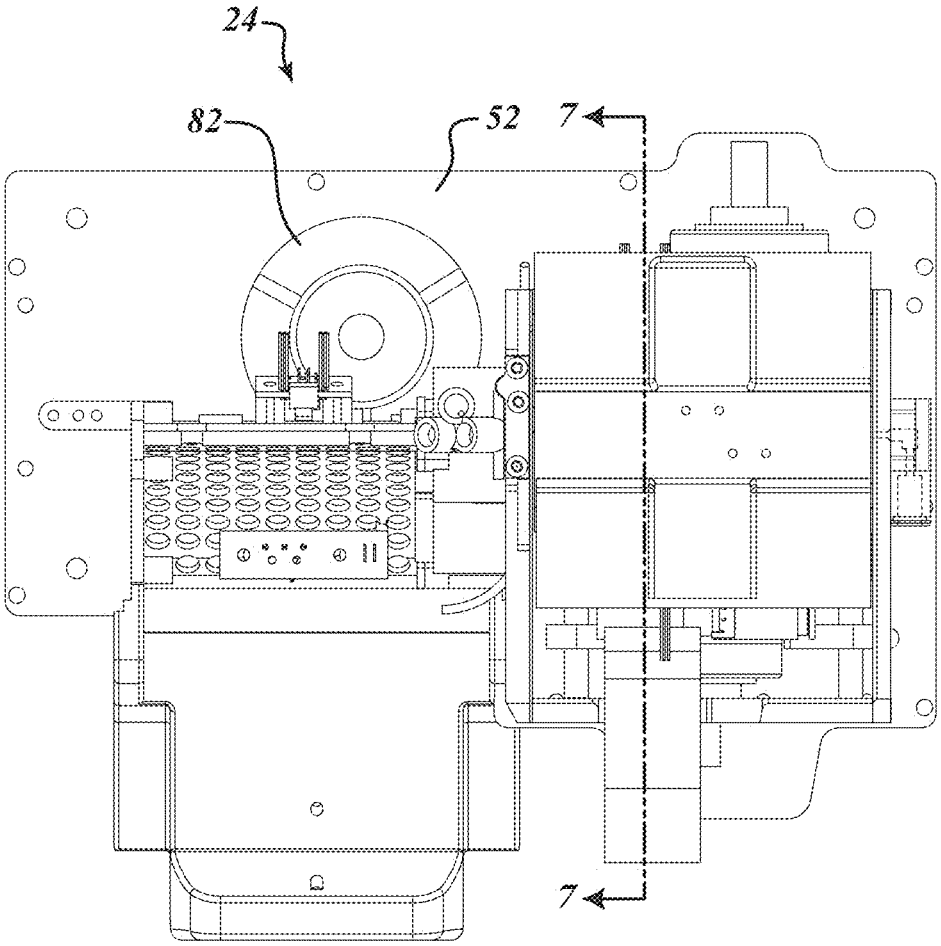
FIG. 5 is a top planar view of a shuffler mechanism made in accordance with principles of the present invention with the cover removed.
Figure 7:
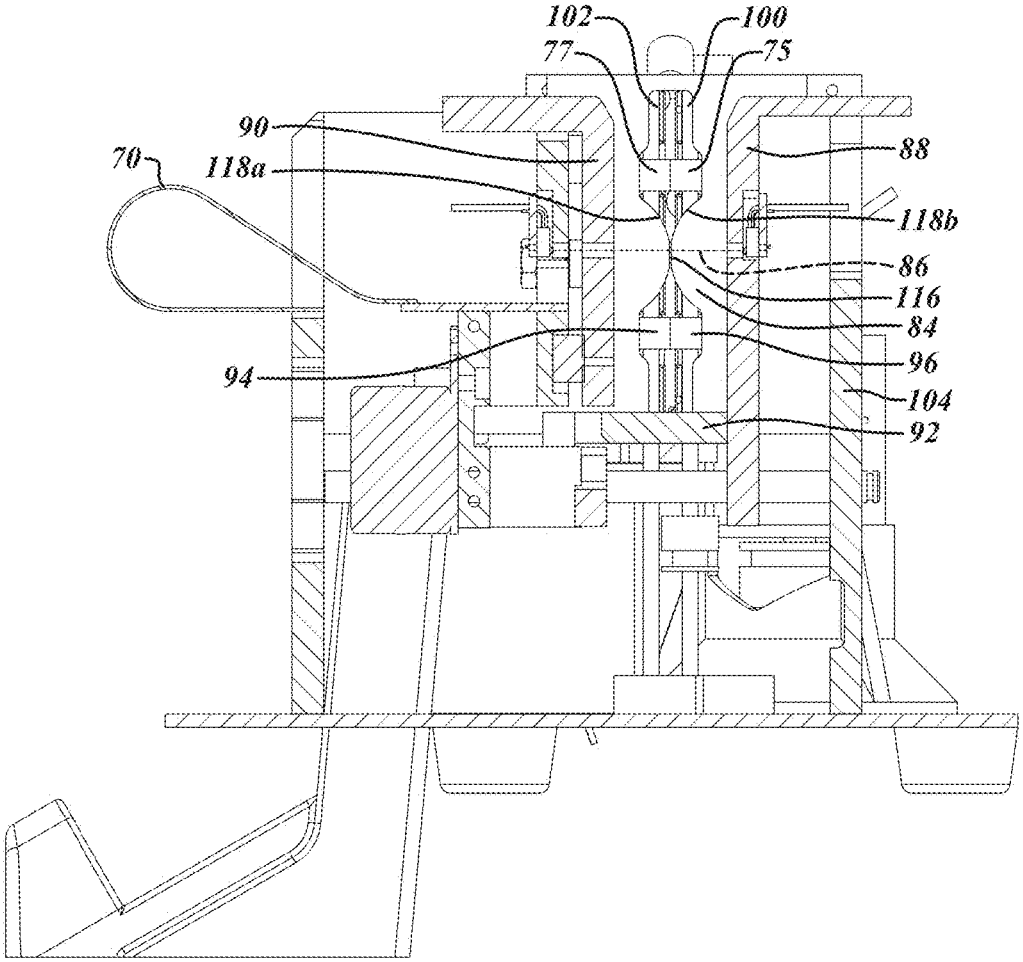
FIG. 7 is a side, cross-sectional view of a shuffler mechanism made in accordance with principles of the present invention.

FIG. 5 is a top view of shuffler mechanism 24. FIG. 5 includes line 7 which is useful for locating where cross-sectional planar view FIG. 7 is taken. As shown in FIG. 5, however, motor 82 is seen from the top. Motor 82 as described below engages mechanically with spinning rollers to cause the same to spin.

FIG. 6 further shows shuffling mechanism 24 including card resting surface 92. Card resting surface 92 is configured to hold a stack of cards to be shuffled and to permit an assembly to move a stack of cards to be shuffled relative to a slot 116. Slot 116 is sized to permit the passage of a single card. In other words, slot 116 is about 0.014 inches. While the depicted slot is about 0.014 inches wide, any distance less than 0.018 inches but more than 0.010 inches will suffice.

The assembly depicted in FIG. 6 is comprised generally of card alignment member 90 and card alignment member 88. Card alignment member 90 and card alignment member 88 are configured to align a stack of cards to be shuffled in a plane that is parallel to the slot 116. In this manner, card alignment members 88 and 90 move a stack of cards to be shuffled 30 relative to slot 116 thereby permitting the burst of air to move one card through slot 116. Card alignment members 88 and 90 are mechanically coupled to horizontal linear stepper motor 94 and horizontal linear stepper motor 60. Horizontal linear stepper motors can be mechanically coupled to card alignment members 88 and 90 in any manner permitting a stack of unshuffled cards to be positioned in a plane that is parallel to or equal to the plane in which slot 116 exists. As depicted, the preferred embodiment includes a vertically oriented slot 116. However, as previously mentioned, one of ordinary skill in the art will appreciate that slot 116 may be horizontally oriented and card alignment members 88 and 90 may also be horizontally oriented such that they are permitted to move a stack of unshuffled cards in and out of various planes that are parallel to slot 116 or equal to the plane in which slot 116 exists.

With continuing reference to FIG. 6, line of sight 86 exists between at least 2 optical sensors (not shown). Line of sight 86 detects the existence of a card to be shuffled 30 between card alignment members 88 and 90. Line of sight 86 can send information to a computer informing a user that at least one card is present between card alignment members 88 and 90 or that no cards are present between card alignment members 88 and 90.

FIG. 6 shows that behind slot 116 are a plurality of rollers 77, 75, 96, and 98. These rollers are attached to spinning shafts 102 and 100. Horizontal linear stepper motor 60 as depicted in FIG. 6 moves to the left and right protruding through void 58 which is cut through front plate 50. Horizontal linear stepper motor 94 as depicted in this embodiment is stationary and is mechanically coupled to move card resting surface 92 back and forth, as depicted (left and right) relative to slot 116. As further shown in FIG. 6, as card resting surface 92 moves left and right, card alignment member 88 and rear top plate 64 move with it. And as depicted, in this embodiment, card alignment member 90 moves towards card alignment member 88 as the deck of cards to be shuffled 30 decreases in size.

FIG. 7 is a cross-sectional view of shuffler mechanism 24 and it shows how card resting surface 92 and card alignment member 88 move left and right relative to slot 116. Slot 116 is cut along radius 118*a* and 118*b*. Radius 118*a* and radius 118*b* can be anywhere from 0.5 cm to 3 and even 4 cm. Preferably each radius is 2 cm forming a slot 116 that is configured to permit the passage of a single playing card. Line of sight 86 is seen in FIG. 7 through 2 optical sensors. Shafts 102 and 100 spin in opposing directions in order to engage at least one edge of a card to be shuffled 30 once said card passes through slot 116. Shafts 102 and 100 spend rollers 77, 75, 94, and 96. Rollers 77, 75, 94, and 96, are made from some rubberized material, such as neoprene or a similar rubberized material. One of ordinary skill in the art can appreciate that a variety of materials may be used for rollers and shafts such that they adequately engage a card to be shuffled 30 in a manner that does not mechanically damage the card to be shuffled 30. FIG. 6 shows that card alignment member 90 is movable through mechanical coupling toward card alignment member 88 as the size of the stack of cards to be shuffled decreases. Of course, slot 116 need not be formed from a radius at all. Slot 116 can be formed from a linear separation or of any other configuration creating a space permitting a single card to pass through it. The shuffler wall 104 can be made from any suitable material, including metal or engineered plastic.

Figure 8A:
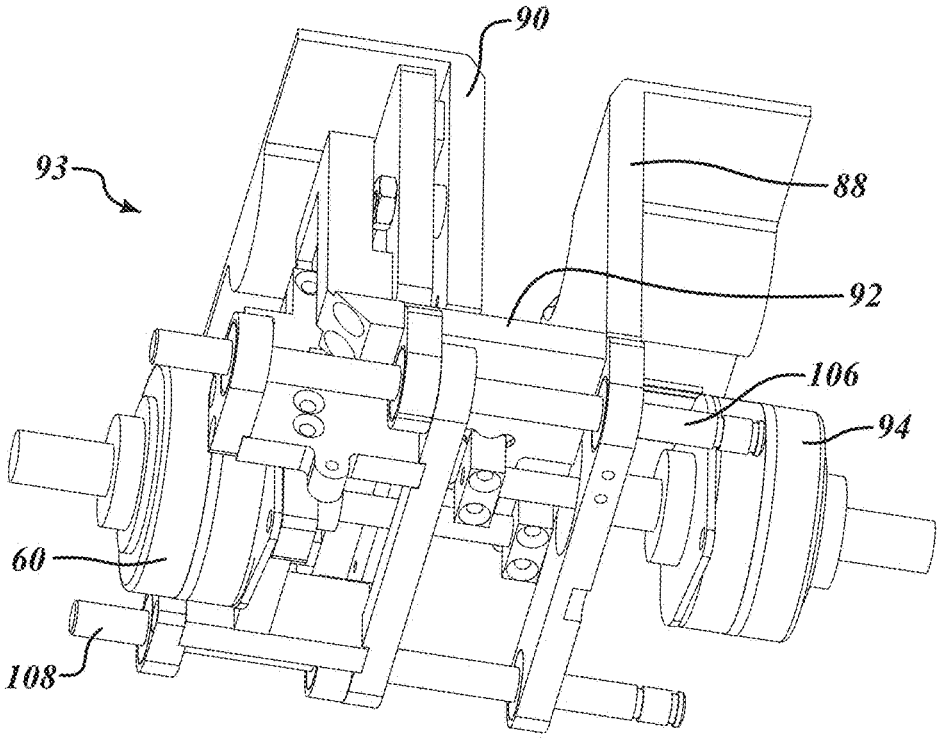
FIG. 8A is a perspective view of a card delivery assembly made in accordance with principles of the present invention.

FIG. 8A depicts card delivery assembly 93 which is comprised generally of card alignment members 90 and 88 as well as linear stepper motors 94 and 60. Card alignment member 88 and card resting surface 92 move in response to action from linear stepper motor 94 linear stepper motor 94 engages through mechanical coupling both card resting surface 92 and card alignment member 88 to move these members relative to slot 116 (not shown) and air holes 78 and 76 (not shown).

Figure 8B:
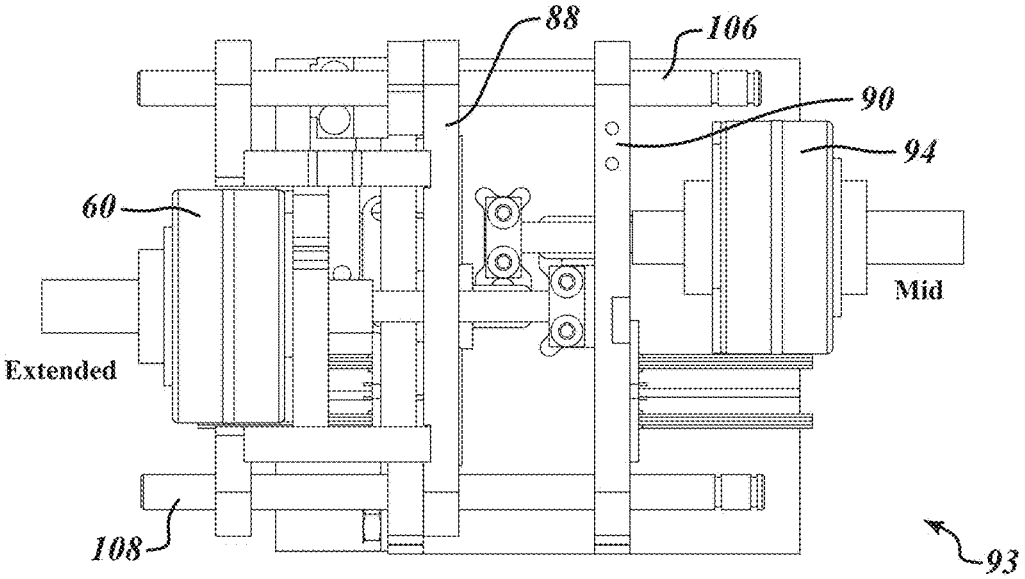
FIG. 8B is a top, planar view of a card delivery assembly made in accordance with principles of the present invention.

FIG. 8B is a top-down planar view of card delivery assembly 93 showing the position such that card alignment members 88 and 90 are equidistant from the middle of card resting surface 92. In other words, this is the "mid" location for card resting surface 92. Further, as seen in FIG. 8B, horizontal stepper motor 60 fully extends along the shaft 108 moving card alignment member 92 a fully extended position relative to card alignment member 88.

Figure 9A:
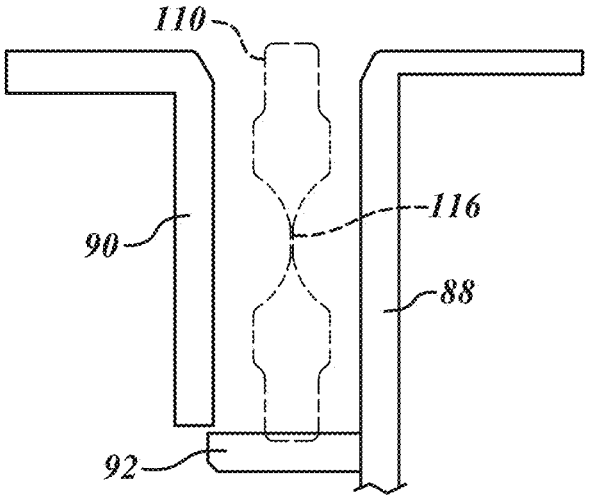
FIG. 9A is a schematic representation of part of a card delivery assembly made in accordance with principles of the present invention.
Figure 9B:
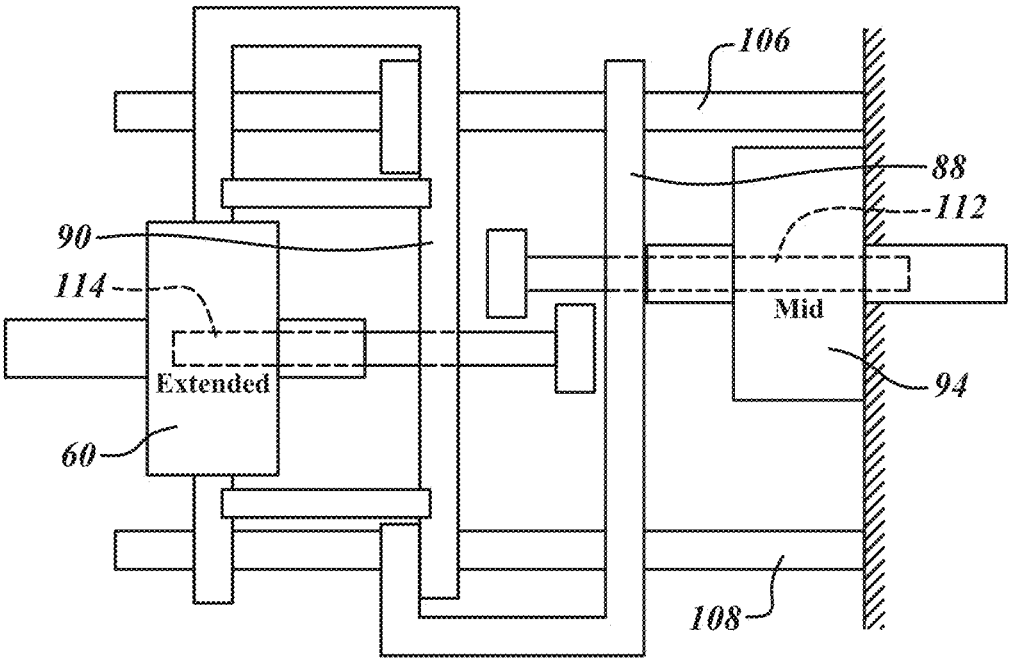
FIG. 9B is a schematic representation of part of a card delivery assembly made in accordance with principles of the present invention.

As seen in FIGS. 9A and 9B, schematically represented, card alignment members 88 and 90 occupy a distance such that the midpoint is occupied by slot 116. Slot 116 is represented in the schematic FIG. 9A by dashed lines 110. Card resting surface 92 moves along with card alignment member 88 as further described and shown.

FIG. 9B is a schematic representation of the card delivery assembly 93 showing how linear stepper motor 94 engages card alignment member 88 sliding it along with card resting surface 92 along shafts 108 and 106 and further sliding card alignment member 90. Vertical stepper motor 94 slides card alignment members 90 and 88 in response to a discrete signal. This discrete signal comes from a random number generator which electronically positions a stack of cards to be shuffled in a random location relative to slot 116. By this process, a random card is selected from a stack of cards to be shuffled and that random card is positioned and made ready to be pushed by a burst of air through slot 116.

As shown schematically in FIG. 9B card alignment members 88 and 90 are in an extended position. Preferably this extended position creates a distance between card alignment members 88 and 90 equal to at least one complete deck of fifty-two or fifty-four playing cards. The extended distance between card alignment members 88 and 90 can, of course, very depending on the number of cards one wishes to shuffle. It is contemplated that several stacks of cards to be shuffled may be placed within the distance between card alignment members 88 and 90 and that a random card may be selected from the deck or multiple decks of cards to be shuffled to be shuffled.

In FIGS. 9B, 10B, 11B, 12B, and 13B, element Nos. 112 and 114, are dashed lines meant to show the travel direction and relative extent of movement for the various mechanical pieces identified in the drawings.

Figure 10A:
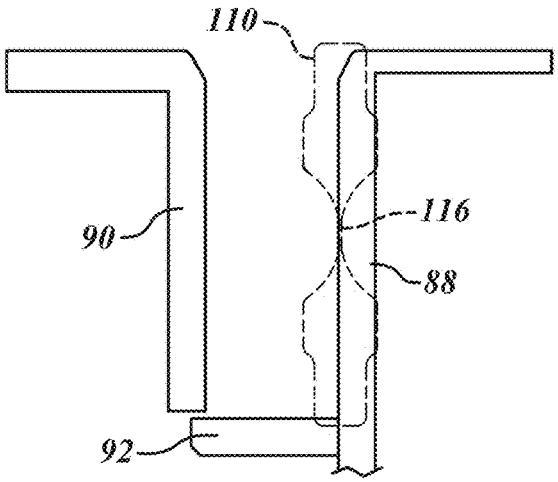
FIG. 10A is a schematic representation of part of a card delivery assembly made in accordance with principles of the present invention.
Figure 10B:
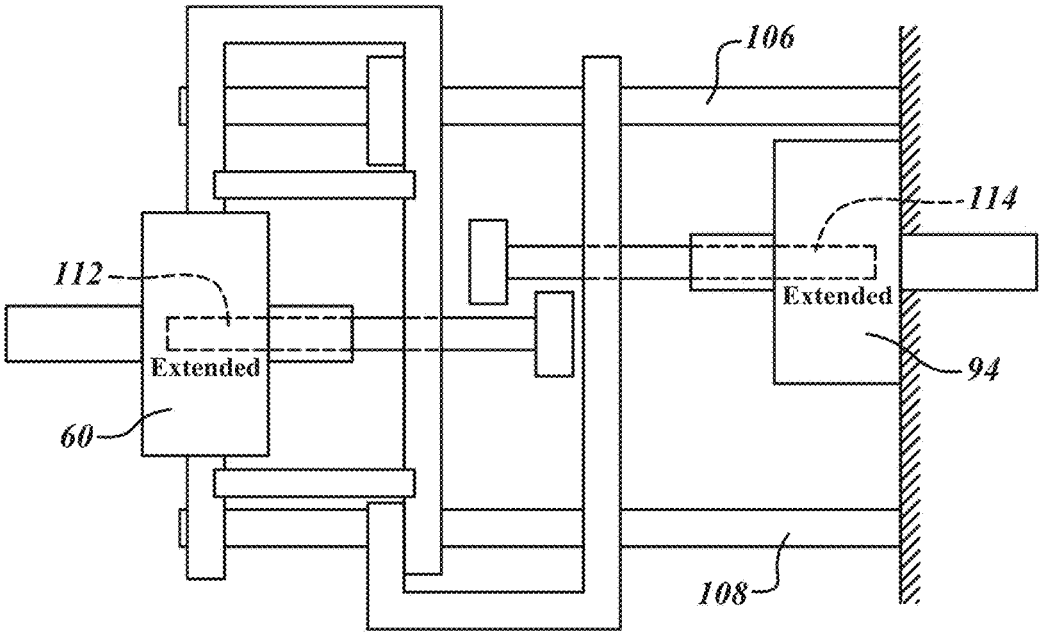
FIG. 10B is a schematic representation of part of a card delivery assembly made in accordance with principles of the present invention.

FIGS. 10A and 10B show schematically the extended position of card alignment members 88 and 90 and further shows an extended position of horizontal stepper motor 94 such that the inner surface of card alignment member 88 is within the same plane as slot 116. As depicted in FIGS. 10A and 10B, card alignment member 88 reaches a maximum distance away from horizontal stepper motor 94 that is equal to the distance of a plane in which slot 116 resides.

Figure 11A:
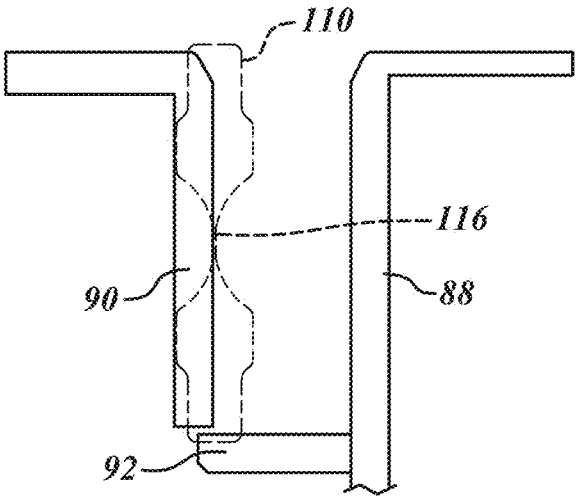
FIG. 11A is a schematic representation of part of a card delivery assembly made in accordance with principles of the present invention.
Figure 11B:
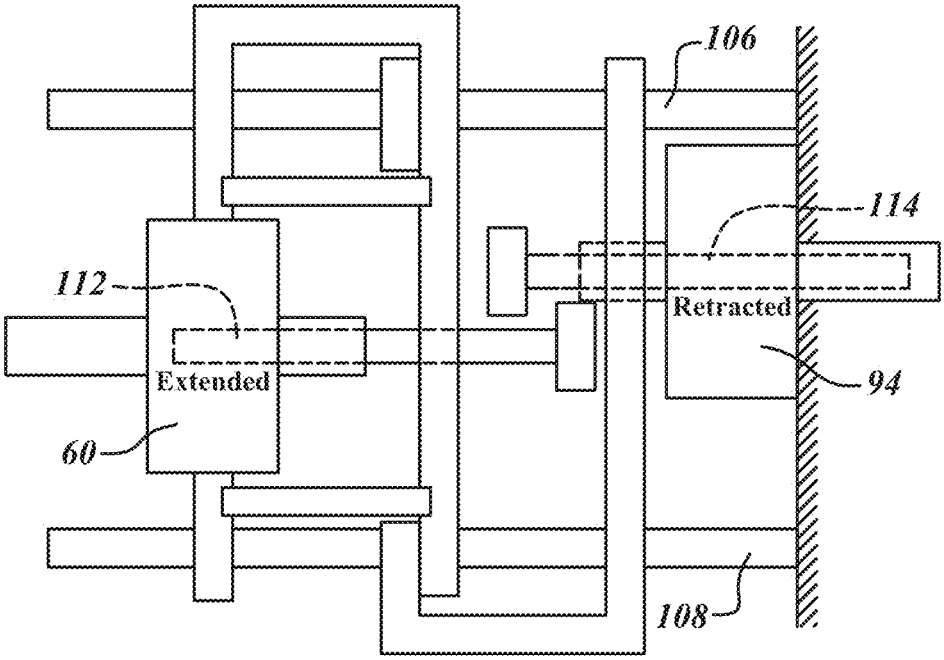
FIG. 11B is a schematic representation of part of a card delivery assembly made in accordance with principles of the present invention.

FIGS. 11A and 11B show a configuration schematically where card alignment members 90 and 88 are fully extended and where horizontal stepper motor 94 is completely retracted such that it moves through mechanical coupling both card alignment member 88 and card alignment member 92 a position whereby the inner surface of card alignment member 90 occupies the same plane as slot 116.

Figure 12A:
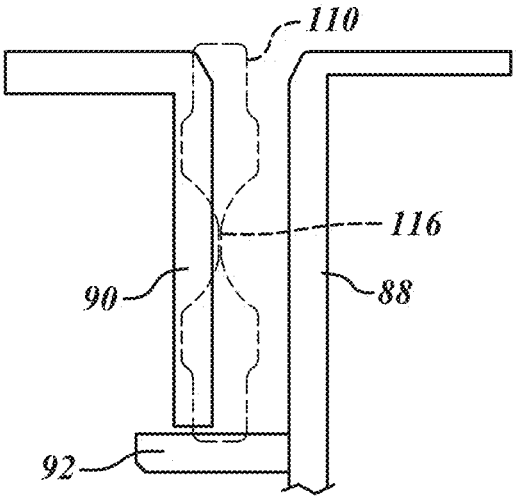
FIG. 12A is a schematic representation of part of a card delivery assembly made in accordance with principles of the present invention.
Figure 12B:
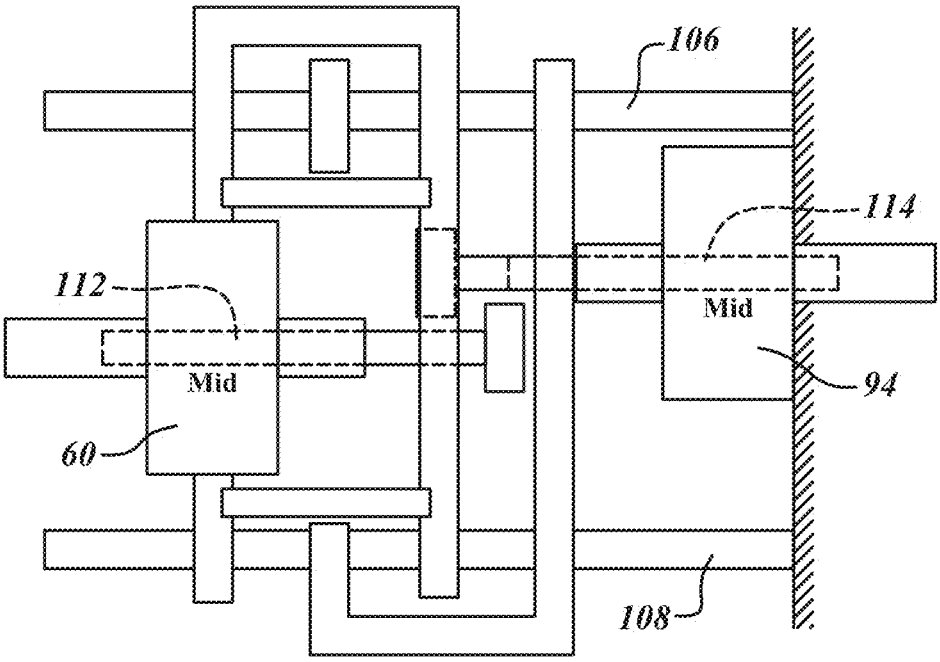
FIG. 12B is a schematic representation of part of a card delivery assembly made in accordance with principles of the present invention.

FIGS. 12A and 12B show a configuration schematically where card alignment members 90 and 88 are closer to one another than previously depicted schematically in FIGS. 10A, 10B, 11A, and 11B. As depicted schematically in FIG. 12B, card alignment members 88 and 90 are relatively close to one another such as in a situation where cards to be shuffled 30 have decreased in size. As depicted schematically in FIGS. 12A and 12B, horizontal stepper motor 94 is retracted to a middle position and horizontal stepper motor 60 is also retracted to a middle position. This creates a position for the inner surface of card alignment member 92 just slightly left of center, or just slightly to the left of slot 116.

Figure 13A:
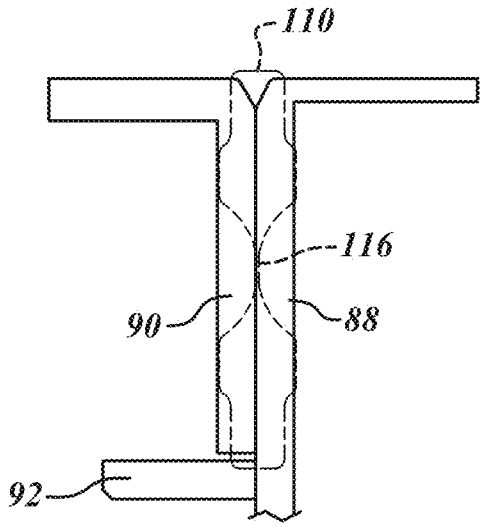
FIG. 13A is a schematic representation of part of a card delivery assembly made in accordance with principles of the present invention.
Figure 13B:
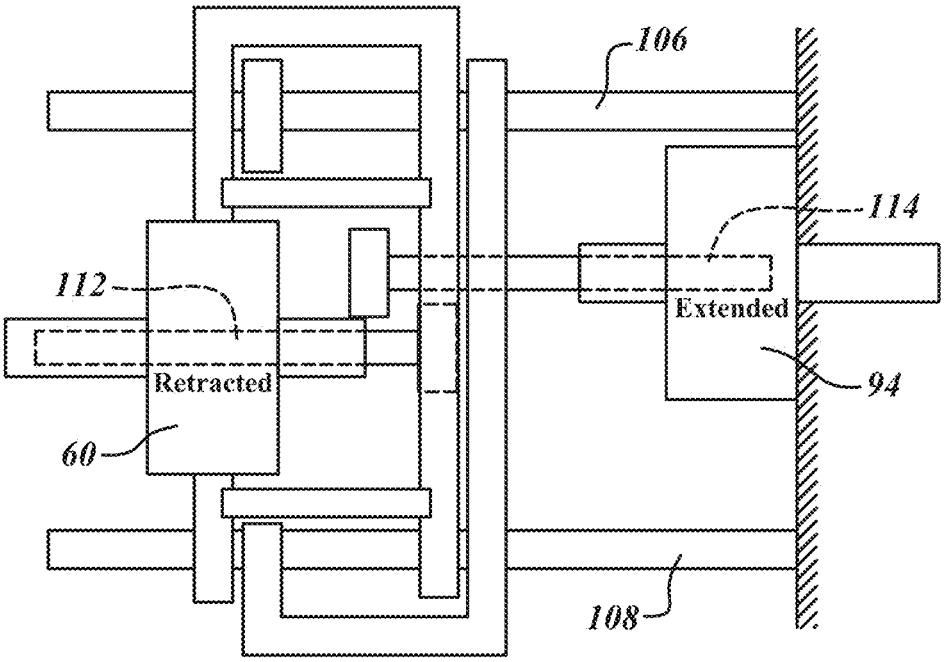
FIG. 13B is a schematic representation of part of a card delivery assembly made in accordance with principles of the present invention.

FIGS. 13A and 13B show a position where vertical stepper motor 94 is fully extended and vertical stepper motor 60 is fully retracted. This results in a position where card alignment member 88 and card alignment member 90 are in contact with one another or at a length from one another that is equal to or less than the width of a single card. In the configuration shown schematically by FIGS. 13A and 13B, the distance between the inner surfaces of card alignment members 88 and 90 is relatively minimal and in the alignment with slot 116.

Figure 14A:
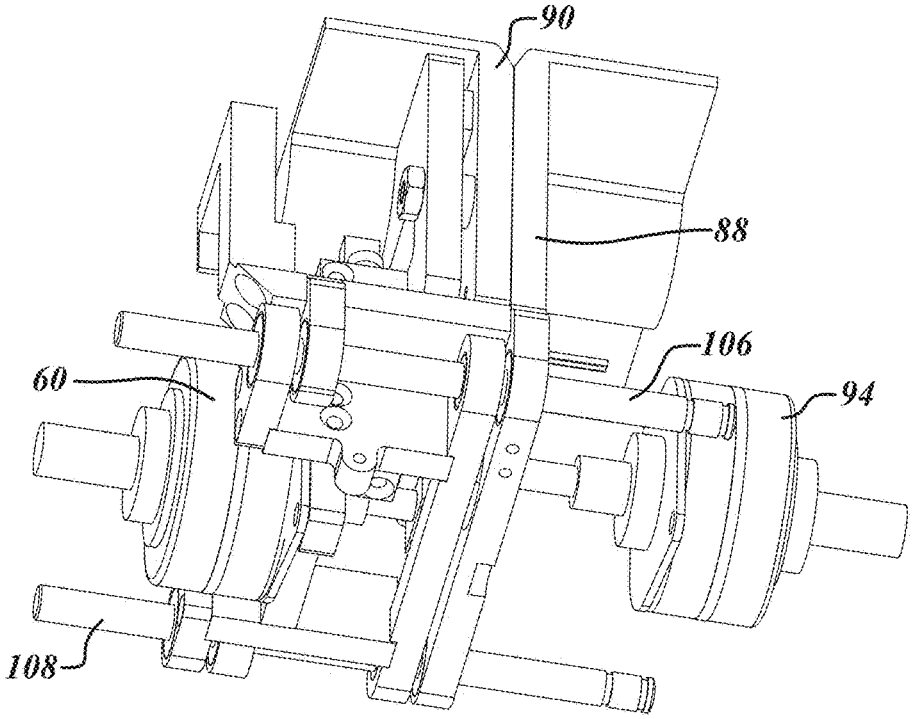
FIG. 14A is a perspective view of a card delivery assembly made in accordance with principles of the present invention.
Figure 14B:
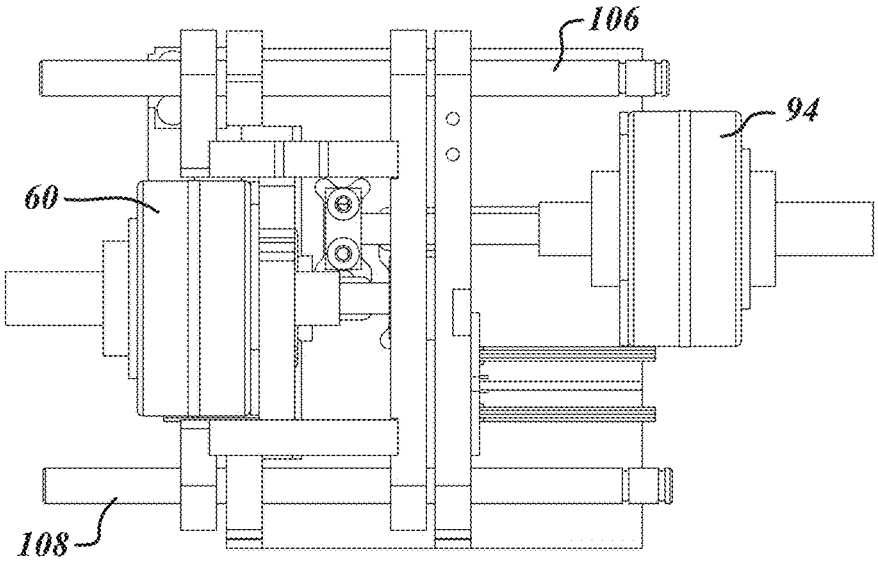
FIG. 14B is a top, planar view of a card delivery assembly made in accordance with principles of the present invention.

FIGS. 14A and 14B show a top perspective and top planar view respectively how card delivery assembly 93 exists when horizontal stepper motor 94 is fully extended and horizontal stepper motor 60 is fully retracted.

Figure 15:
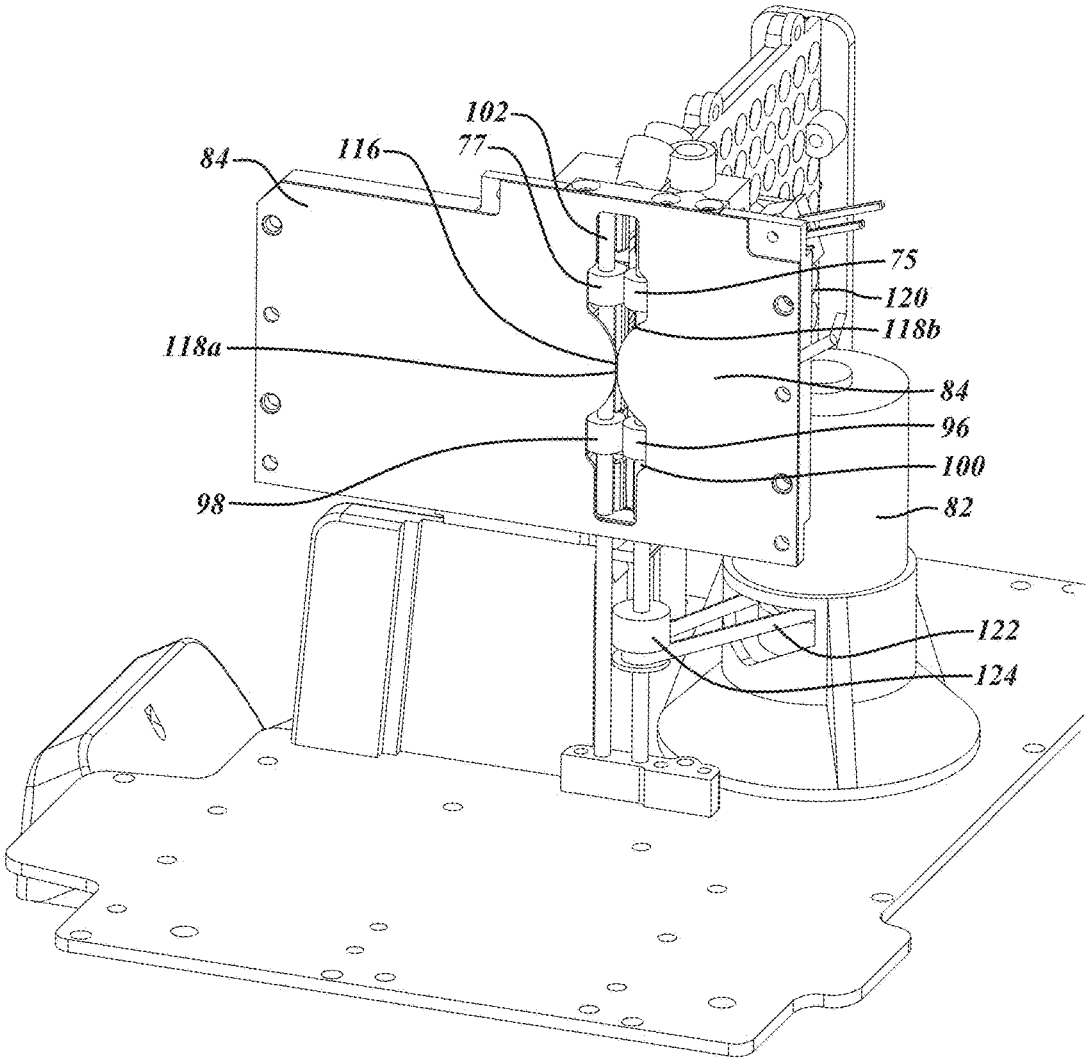
FIG. 15 is a perspective view of part of a shuffler mechanism made in accordance with principles of the present invention.

FIG. 15 depicts portions of the shuffler assembly 24 including the slot 116 formed within card passing plate 84. Card passing plate 84 is mounted within a plane that is normal to the direction of travel of the cards to be shuffled 30. As depicted in FIG. 15, slot 116 is formed between radii 118*a* and 118*b*. These radii form slot 116 such that slot 116 is approximately 0.014 inches. Preferably, slot 116 as formed in card passing plate 84 is no larger than the width of 2 playing cards. In other words, it is less than the width of 2 playing cards or less than 0.018 inches thick.

FIG. 15 shows motor 82 and how motor 82 is preferably mechanically coupled to shafts 102 and 100. Shafts 102 and 100, which are both driven by belt 122 which rotates shafts 101 and 102 through contact with roller gear 124. Roller gear 124 engages shaft 102 rotating rollers 77, 75, 98 and 96. Upon the rotation of rollers 96, 98, 77, and 75, the card will pass through slot 116 in between the curved radii 118*a* and 118*b*.

Figure 16:
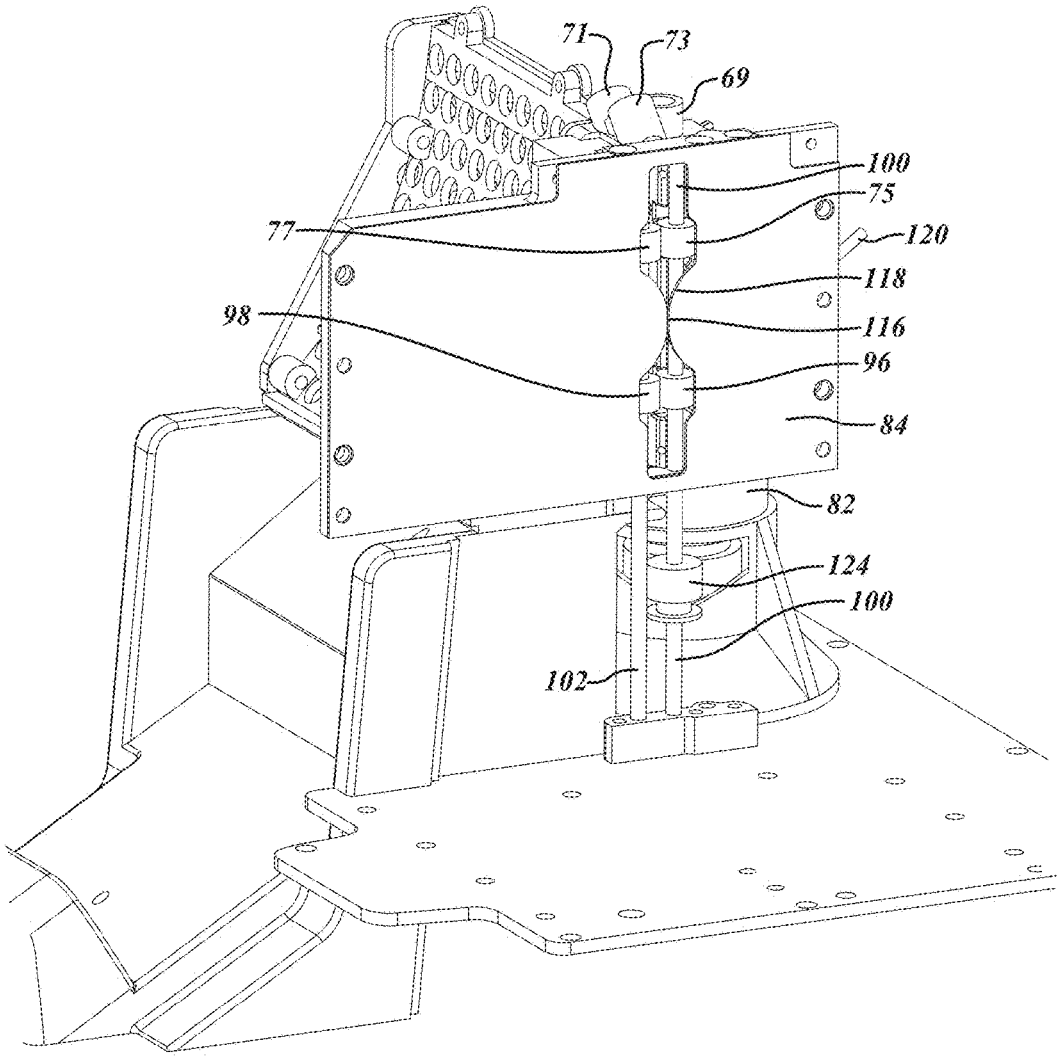
FIG. 16 is a perspective view of part of a shuffler mechanism made in accordance with principles of the present invention.

FIG. 16 shows shuffler mechanism 24 along with shafts 102 and 100. Air inlet 71 and 73 as well as 69 provide air into the area where shuffled cards are delivered. Fiber optic cable 120 is electronically connected to rollers 77, 75, 98 and 96, and fiber optic cable 120 is configured to send a signal to the rollers when a card to be shuffled 12 is pushed through slot 116.

Figure 17:
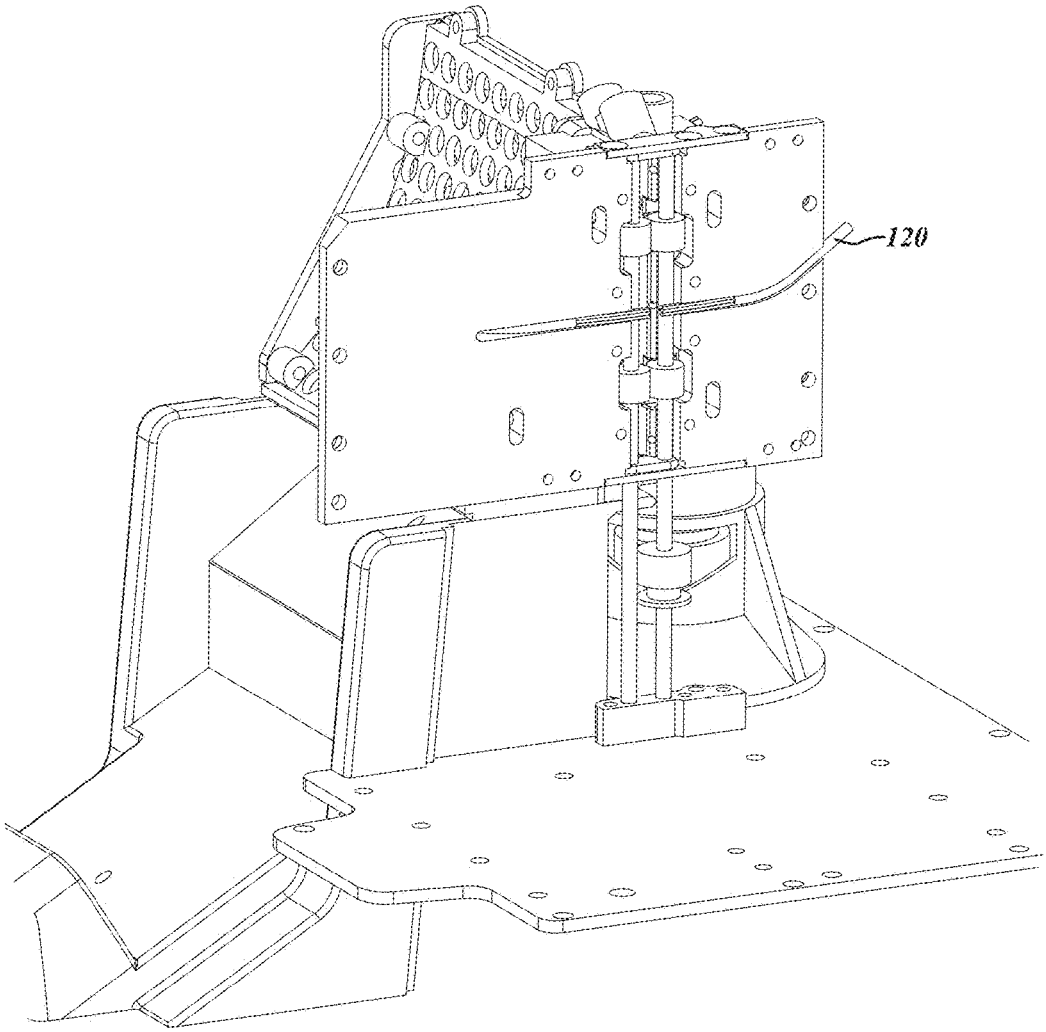
FIG. 17 is a perspective view of part of a shuffler mechanism made in accordance with principles of the present invention.
Figure 18:
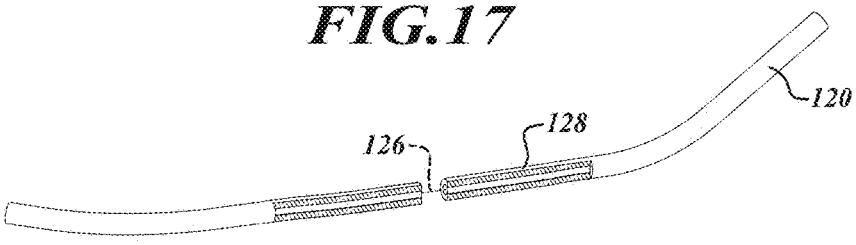
FIG. 18 is a partial view of a fiber-optic cable made in accordance with principles of the present invention.

As seen in FIGS. 16, 17, and 18, fiber optic cable 120 (including cross-sectional area 128) is embedded within a space provided behind plate 84 (labeled in FIG. 16). Once a card to be shuffled 12 is pushed beyond the plane in which plate 84 exists, line of sight 126 is broken, and a signal is sent from fiber optic cable 122 the rollers so that the rollers are engaged. Alternatively, the rollers can be continuously spinning.

Figure 19:
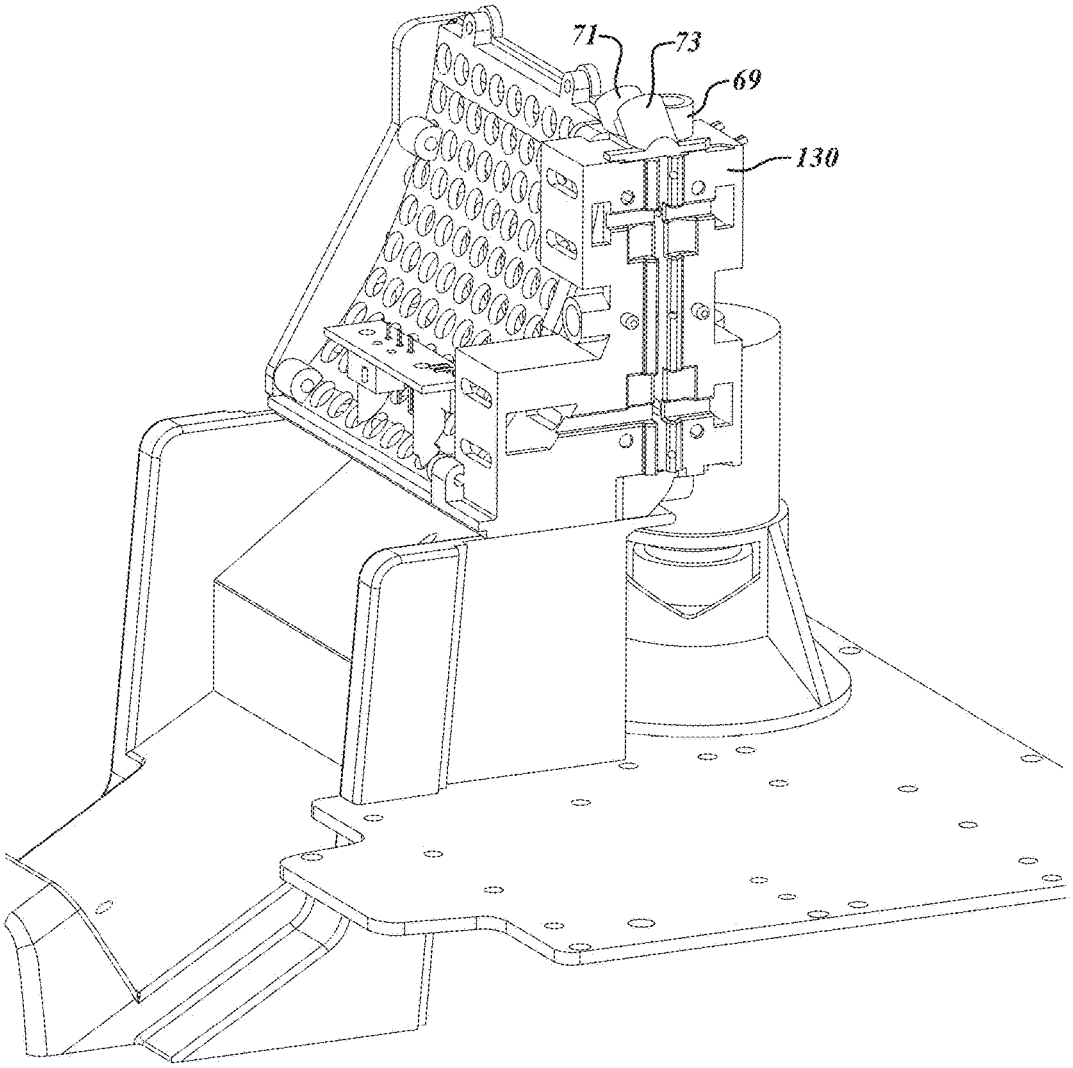
FIG. 19 is a perspective view of part of a shuffler mechanism made in accordance with principles of the present invention.

FIG. 19 shows air inlets 71, 73, and 69 as well as secondary air manifold 130. Secondary air manifold 130 exists between the area for the delivery of shuffled cards and the area housing cards to be shuffled 12. Secondary air manifold 130 provides means for the delivery of several puffs of air in variable directions and at a location past the rollers 77, 75, 98, and 96. Secondary air manifold is configured to deliver a plurality of air bursts both to the direction of the stack of cards to be shuffled 12 as well as in the direction of the area where cards are to be delivered in a shuffled state. Air manifold 130, for example, can deliver a plurality of air bursts in the direction of perforated guiding members 32. Further, secondary air manifold 130 can deliver a plurality of puffs of air to the card catch assembly 29 and the card catchment area 22.

With further reference now to FIGS. 20 through 26, secondary air manifold 130 is described in greater detail. Air is pumped through secondary air manifold 130 at inlets 401*a*, 402*a* and 403*a*. As well as 404*a*, 405*a*, 406*a*, 407*a*, and 408*a*. Bursts of air exit secondary air manifold at 401*b*, 402*b*, 403*b*, 404*b*, 405*b*, 406*b*, 407*b*, and 408*b*. FIG. 24 depicts the rear piece 132 of secondary manifold 130. Preferably, secondary air manifold is made up of 2 pieces rear piece 132 and front piece 135. Rear piece 132 in front piece 135 are sandwiched get together. Front piece 135 and rear piece 132, are engaged and configured to form a plurality of air channels through which bursts of air can be delivered by secondary air manifold 130.

Figure 25:
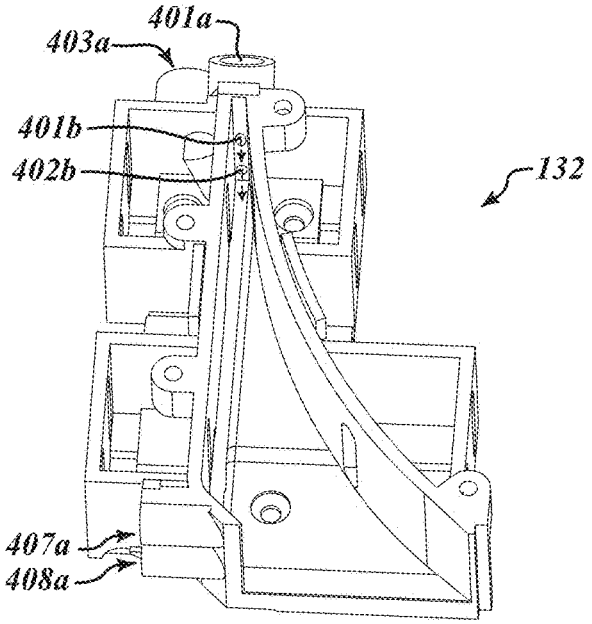
FIG. 25 is a perspective view of part of a shuffler mechanism made in accordance with principles of the present invention.
Figure 26:
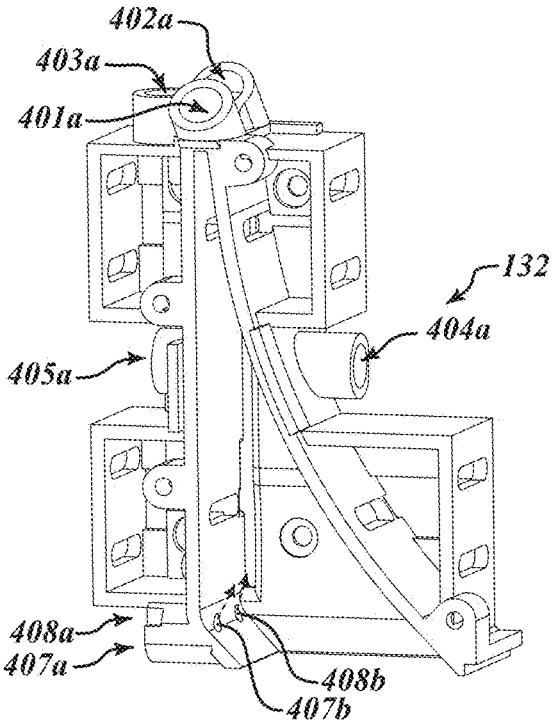
FIG. 26 is a perspective view of part of a shuffler mechanism made in accordance with principles of the present invention.

FIGS. 25 and 26 show the rear piece in greater detail. As depicted, rear piece 132 includes outlets 407*b* and 408*b*. These outlets deliver bursts of air to cards to be shuffled 12. FIG. 25 shows air outlets 401*b* and 402*b*. Outlets 401*b* and 402*b* are configured to deliver bursts of air to cards to be shuffled 12. The plurality of air outlets from secondary air manifold 130 and within the secondary air manifold 130 provide structure for the manipulation of cards to be shuffled 12 in a variety of directions such that jams can be avoided. Secondary air manifold 130 includes a plurality of air passages as depicted in FIGS. 23 and 24. This plurality of air passages is connected to a computer that delivers a plurality of air bursts in response to a signal the signal can be sent for any number of reasons including a card jamming in the area for the delivery of shuffled cards or in any other area of the shuffler mechanism 24.

Air including bursts of air can be provided to shuffler mechanism 24 as well as the primary air manifold 42 and secondary air manifold 130 in a variety of ways including internal or external air sources. Shuffler mechanism 24, for example, can be hooked up to continuous air supplies provided by air compressors pumps or house air. Alternatively, shuffler mechanism 24 can be supplied air by internal sources such as compressed gas including compressed carbon dioxide. Alternatively, air can be delivered in discrete bursts to primary air manifold 42 as well as secondary air manifold 130 by mechanical or pneumatic means. For example, technology well known in the art for delivering discrete bursts of air to paintball guns can be adapted for use in connection with shuffler mechanism 24. Sometimes these guns are pneumatically driven by an air compressor or battery-powered source. Alternatively, an electrical current from a battery may spark a plug which causes a small explosion of a flammable gas such as butane which can drive a piston thereby delivering air to primary air manifold 42 or secondary air manifold 130 or both.

Preferably, air delivery into primary air manifold 42 and secondary air manifold 130 is computer-controlled. A computer processor receives signals indicating the number of cards to be shuffled, and the position of the articulating mechanisms moving relative to slot 116. At a predetermined time, bursts of air are sent in response to signals from a computer processor; these bursts of air deliver a card through slot 116 at a predetermined time and at a position in the stack of cards to be shuffled 12 that is determined by a random number generator.

Figure 27:
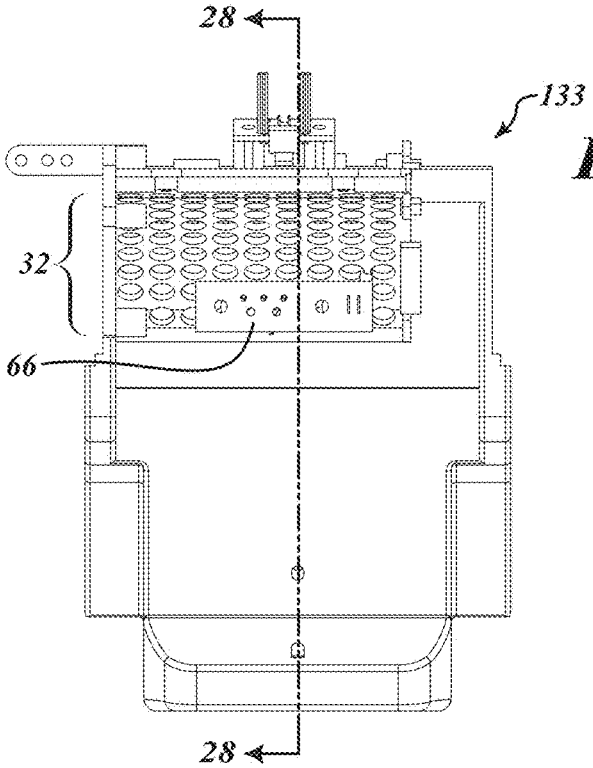
FIG. 27 is a top planar view of a chute made in accordance with principles of the present invention.
Figure 28:
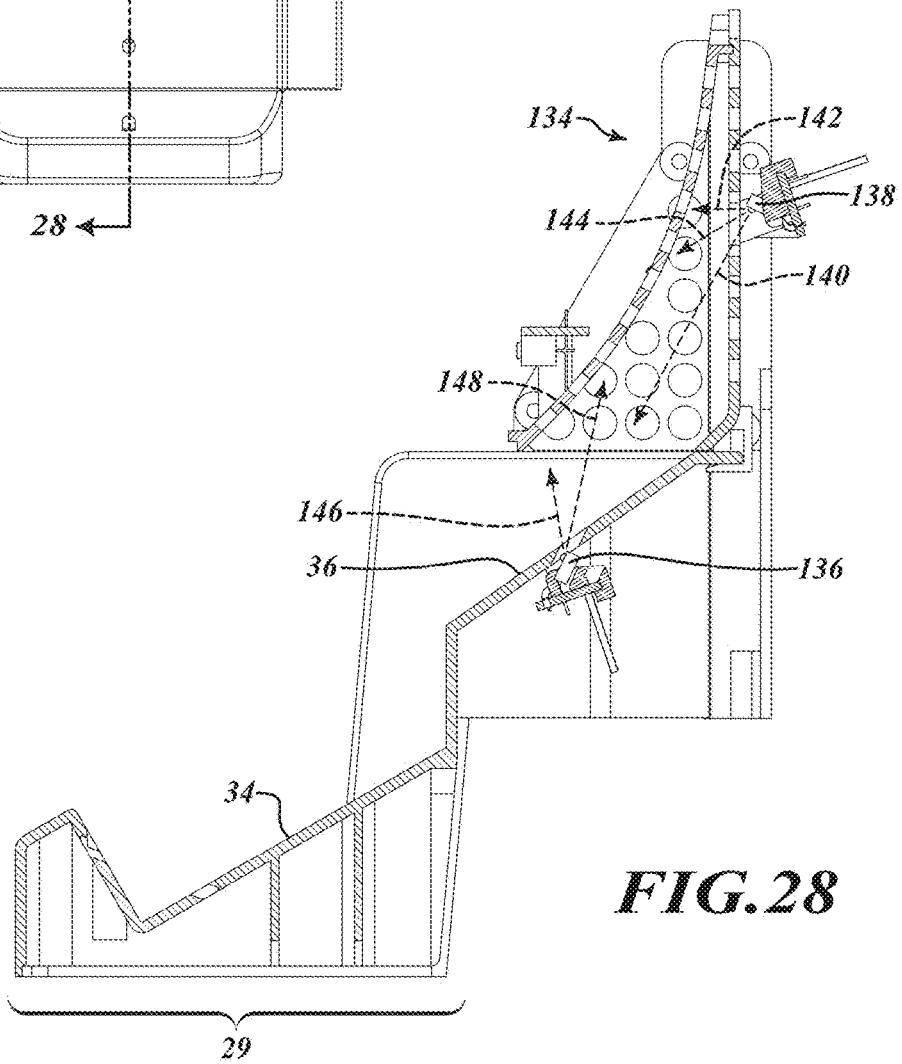
FIG. 28 is a side cross-sectional view of a chute made in accordance with principles of the present invention.

FIG. 27 shows 133, the card-catchment side of the invention, including perforated guiding members 32 and the area where FIG. 28 shows a cross-section (line 28) of shuffler mechanism 24. The shuffler mechanism 24 is shown in cross-section in FIG. 28. In cross-sectional view, FIG. 28 depicts the card catchment area as well as the card catch assembly. Also seen in FIG. 28, card-catchment side 134 (seen in cross-sectional view), includes upper card landing area 36 and lower card landing area 34. Optical sensors 136 and 138 are in signal communication via line of sight 140, line of sight 142, line of sight 144, line of sight 146, and line of sight 148. The plane 134 in which these lines of sight exist between optical sensor 136 and 138, runs perpendicular or normal to the direction of travel of cards to be shuffled when they are delivered into the area for shuffled cards and into the perforated guiding members 32. By having optical sensors 138 and 136 positioned to detect the presence or absence of a card traveling into perforated guiding members 32. Signals are sent to circuit board 66 regarding the presence or absence of a card within perforated guiding members 32.

Optical sensors 138 and 136 can alternatively be used to view cards including the value of cards and transmit that information to a computer for any number of purposes including, for example, determining whether and if a particular card has been delivered from the cards to be shuffled 12 to the area in which shuffled cards exist. In this regard, shuffler mechanism 24 can detect presence of certain cards and report the same to the dealer, or to a monitor or other display (not shown).

Figure 29:
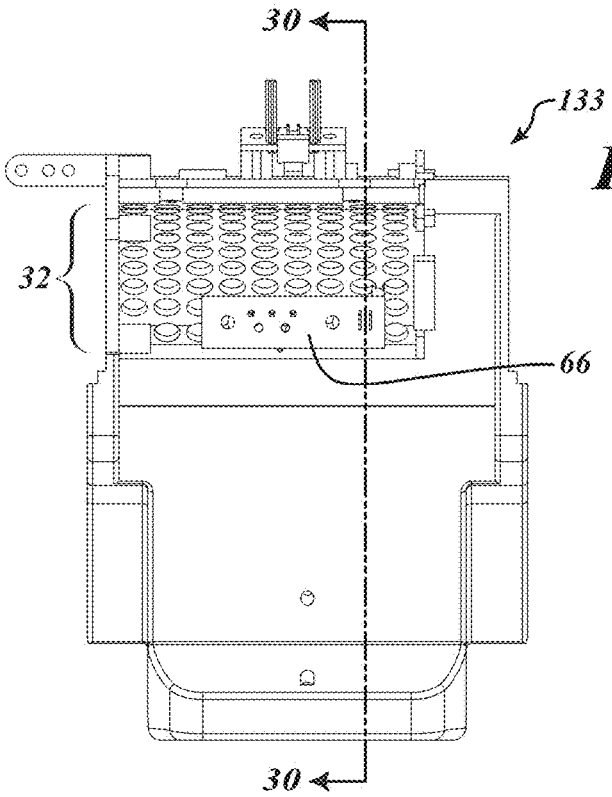
FIG. 29 is a top planar view of a chute made in accordance with principles of the present invention.
Figure 30:
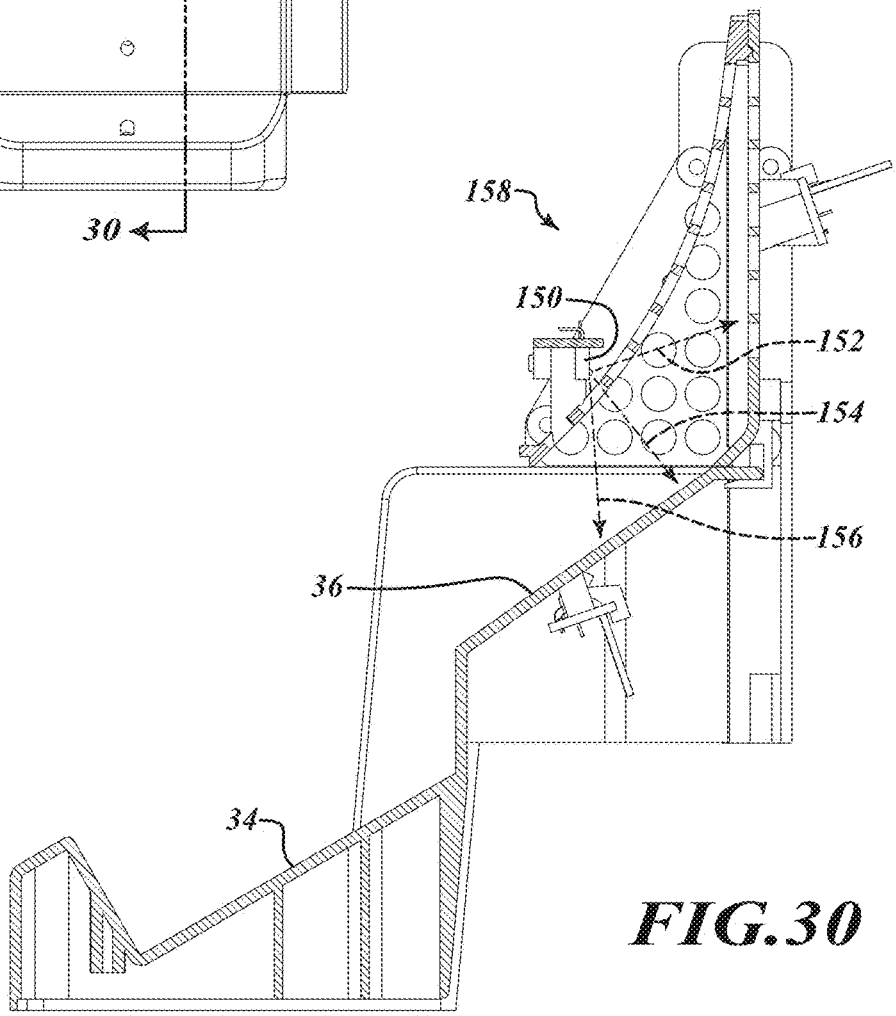
FIG. 30 is a side cross-sectional view of a chute made in accordance with principles of the present invention.

Optical sensor 150 is depicted in FIG. 30, a cross-sectional view along line 30 as depicted in FIG. 29. Optical sensor 150 is in signal communication with a computer and is configured to detect, or alternatively read, cards within the area for the delivery of shuffled cards. Optical sensor 150 detects or alternatively reads cards along line of sight 152, line of sight 154, and/or, line of sight 156. Cross-sectional view within plane 158, has depicted in FIG. 30, is located in the area of travel of cards to be shuffled 12 as they travel from the slot 116 and into the perforated guiding members 32. Optical sensor 150 can detect a jam, or alternatively it is configured to detect whether or not a card has been successfully delivered to upper card landing area 36.

Additional optical sensors can be added to the area where shuffled cards are delivered in clear including on either side of perforated guiding members 32. In this manner, cards that are delivered to the card catchment area 29, as they pass through upper card landing area 36 and lower card landing area 34, can be detected by a computer and in response signals can be sent to a user and displayed on a display (not shown). Further, warnings or signals can be sent to the dealer or players in response to the presence or absence of certain cards within the area for the delivery of shuffled cards depicted in this embodiment as card catchment area 29.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mechanical shuffler comprising:

a generally planar base, a platform sized to receive at least one deck of unshuffled cards, the platform movable in a direction of travel parallel to the generally planar base, a first electrically powered motor mechanically coupled to the platform and configured to move the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards a primary air manifold attached to a manifold plate, the manifold plate having at least one hole positioned adjacent to the platform and configured to deliver a burst of air to at least one edge of a playing card, the hole configured to deliver the burst of air in a direction toward the slot to move the playing card through the slot.

2. The mechanical shuffler of claim 1 further comprising a computer, the computer including a processor, display, and user interface.

3. The mechanical shuffler of claim 1, the primary air manifold configured to deliver the burst of air in response to a second signal.

4. The mechanical shuffler of claim 3 further comprising at least one roller, the roller configured to spin in response to a third signal.

5. The mechanical shuffler of claim 4 including at first optical sensor, the first optical sensor configured to send a signal to the roller.

6. The mechanical shuffler of claim 1 further comprising a secondary air manifold.

7. The mechanical shuffler of claim 6, the secondary air manifold including at least one air inlet and a plurality of air outlets, the plurality of air outlets configured to deliver a burst of air to at least one edge of a playing card.

8. A mechanical shuffler comprising:

a generally planar base, a platform sized to receive at least one deck of unshuffled cards, the platform movable in a direction of travel parallel to the generally planar base, a first electrically powered motor mechanically coupled to the platform and configured to move the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards, a chute located in the area for delivery of shuffled cards, the chute including a plurality of perforations, the perforations configured to diffuse a burst of air of a predefined pressure and volume, and a primary air manifold attached to a manifold plate, the manifold plate having at least one hole positioned adjacent to the platform and configured to deliver a burst of air to the at least one edge of a playing card, the hole configured to deliver the burst of air in a direction toward the slot to move the card through the slot.

9. The mechanical shuffler of claim 8 further comprising a secondary air manifold.

10. The mechanical shuffler of claim 9, the secondary air manifold including at least one air inlet and a plurality of air outlets, the plurality of air outlets configured to deliver a burst of air to at least one edge of a playing card.

11. The mechanical shuffler of claim 8 further comprising a plurality of rollers, the rollers configured to spin in response to a first signal.

12. The mechanical shuffler of claim 8 further comprising at least one optical sensor, the sensor configured to detect the presence or absence of a card in the chute.

13. A mechanical shuffler comprising:

a generally planar base, a platform sized to receive at least one deck of unshuffled cards, the platform movable in a direction of travel parallel or normal to the generally planar base member, a first electrically powered motor mechanically coupled to the platform and configured to move the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards, a primary air manifold attached to a manifold plate, the manifold plate having at least one hole positioned adjacent to the platform and configured to deliver a burst of air to at least one edge of a playing card, the hole configured to deliver the burst of air in a direction toward the slot to move the playing card through the slot.

14. The mechanical shuffler of claim 13 further comprising a computer, the computer including a processor, display, and user interface.

15. The mechanical shuffler of claim 13, the primary air manifold configured to deliver the burst of air in response to a second signal.

16. The mechanical shuffler of claim 15 further comprising at least one roller, the roller configured to spin in response to a third signal.

17. The mechanical shuffler of claim 16 including at first optical sensor, the first optical sensor configured to send a signal to the roller.

18. The mechanical shuffler of claim 13 further comprising a secondary air manifold.

19. The mechanical shuffler of claim 18, the secondary air manifold including at least one air inlet and a plurality of air outlets, the plurality of air outlets configured to deliver a burst of air to at least one edge of a playing card.

* * * * *